US010342355B2

(12) United States Patent
Derecktor et al.

(10) Patent No.: US 10,342,355 B2
(45) Date of Patent: Jul. 9, 2019

(54) STOWABLE EXERCISE CHAIR FOR STANDING DESKS

(71) Applicant: Derecktor Marine Technology LLC, Bristol, RI (US)

(72) Inventors: Thomas Derecktor, Portsmouth, RI (US); Michael Miller, Portsmouth, RI (US); Rebecca Lorick, Ann Arbor, MI (US)

(73) Assignee: Derecktor Marine Technology LLC, Bristol, RI (US)

( * ) Notice: Subject to any disclaimer, the term of this patent is extended or adjusted under 35 U.S.C. 154(b) by 0 days.

(21) Appl. No.: 15/940,492

(22) Filed: Mar. 29, 2018

(65) Prior Publication Data

US 2018/0279793 A1 Oct. 4, 2018

Related U.S. Application Data

(60) Provisional application No. 62/479,039, filed on Mar. 30, 2017.

(51) Int. Cl.

| | |
|---|---|
| ***A47C 7/50*** | (2006.01) |
| ***A47C 9/00*** | (2006.01) |
| ***A63B 23/00*** | (2006.01) |

(52) U.S. Cl.

CPC ..... *A47C 9/005* (2013.01); *A47C 7/503* (2013.01); *A47C 7/5066* (2018.08); *A63B 2023/006* (2013.01); *A63B 2208/0233* (2013.01); *A63B 2210/02* (2013.01); *A63B 2210/50* (2013.01)

(58) Field of Classification Search

CPC ..... A63B 23/0205; A63B 2208/0233; A63B 2023/006; A63B 2210/02; A63B 2210/50; A47C 7/5066; A47C 7/52; A47C 9/005; A47C 9/002; A47C 7/503; A47C 7/506

USPC ..... 297/423.12, 423.11, 423.19, 195.11, 297/423.4, 258.1, 337, 214

See application file for complete search history.

(56) References Cited

U.S. PATENT DOCUMENTS

| | | | | | |
|---|---|---|---|---|---|
| 135,924 | A * | 2/1873 | Lyon | A47C 9/005 | 248/397 |
| 1,194,551 | A * | 8/1916 | Schossler | A47C 9/002 | 108/2 |
| 4,650,249 | A | 3/1987 | Serber | | |
| 5,149,174 | A | 9/1992 | Charash | | |
| 5,255,957 | A * | 10/1993 | Opsvik | A47C 9/005 | 297/423.12 |
| 6,398,699 | B1 * | 6/2002 | Yang | A63B 22/14 | 482/142 |
| 7,108,642 | B1 | 9/2006 | Stearns | | |
| 7,367,623 | B2 * | 5/2008 | Tholkes | A47C 9/005 | 297/300.8 |

(Continued)

*Primary Examiner* — Milton Nelson, Jr.

(74) *Attorney, Agent, or Firm* — Barlow, Josephs & Holmes, LTD; David R. Josephs

(57) ABSTRACT

The chair of the present disclosure balances safety, comfort, ergonomics, numerous desk geometries, a variety of floor surfaces, the physics of cantilevered elements, the height of floor obstacles, and a large range of body types/sizes. It can address the recommendations of ergonomic experts and adds the unique forward footrest/exercise bar for stretching, core workouts, and to increase the variety of ergonomic seating positions. The entire product can fold into a compact light weight package for easy transport and stowage.

12 Claims, 23 Drawing Sheets

(56) References Cited

U.S. PATENT DOCUMENTS

| | | | | |
|---|---|---|---|---|
| 7,407,225 | B2 * | 8/2008 | Bigolin ..... | B62J 1/08<br>248/298.1 |
| 2002/0101108 | A1 | 8/2002 | Roleder et al. | |
| 2010/0125030 | A1 | 5/2010 | Shifferaw | |
| 2013/0306831 | A1 | 11/2013 | Keen et al. | |
| 2014/0159453 | A1 | 6/2014 | Elliott et al. | |

* cited by examiner

STOWABLE EXERCISE CHAIR FOR STANDING DESKS

CROSS REFERENCE TO RELATED APPLICATION

This application is related to and claims priority from the filed U.S. Provisional Application No. 62/479,039, filed Mar. 30, 2017, entitled "STOWABLE EXERCISE CHAIR FOR STANDING DESKS," incorporated by reference in its entirety herein.

BACKGROUND

The present disclosure is related generally to seating, desks, tables and other structures for supporting a person or objects. It is particularly useful for all users of standup desks, professionals, academics, programmers, architects, engineers, sailors, cyclists, basically anyone seeking a core workout, or an active seating experience at a desk, with healthier more ergonomic seating options and the like.

It is increasingly well known in the ergonomic office furniture industry that standup desks have the potential to provide a significant healthy benefit for the user. However, as with sitting, standing sedentarily for long periods of time may increase the users risk of developing physical pain and other health issues. As a result, standing desks need to be paired with an ergonomic standing chair that can support the user when fatigued and allow the user to take breaks from standing.

In addition, scientists in the fields of biology, biomechanics, and ergonomics have identified serious health risks—from back pain to increased risk of heart disease and diabetes—that result from sitting in the wrong ergonomic position and from sitting or standing in static positions for extended periods of time. In August of 2016, the American Heart Association published a review of many of this current research in the journal, *Circulation*. After reviewing this data, they concluded that people should try to "move more and sit less" in order to mitigate the health risks associated with being sedentary for too long. Thus, there is a significant need to design furniture that addresses the health problems associated with seating arrangements that result in poor ergonomic postures and the lack of physical activity/movement. There have been many attempts in the prior art to meet these needs. However, each of the current known prior art standup chairs suffer from at least one of the following problems:

a. They are in the way when not in use.
b. They don't allow easy transitions between sitting and standing or between different positions while seating.
c. Little additional exercise benefit is provided by the chair.
d. There is no sit-up, back extension, or stretching exercise capability provided by the chair.
e. Foot rests are often uncomfortably located directly below the chair, which is ergonomically undesirable. Further, no footrests are available that extend in front of the user.
f. They do not include multiple footrests that support the user while sitting in a variety of postures.
g. They do not include footrests and pegs that can be used while standing to facilitate more dynamic and ergonomic standing positions.

h. They do not include an ergonomic seat pan that is designed to optimally position and actively rotate the pelvis and support the spine in more than one healthy sitting or leaning posture.
i. Lack of ease of storage and transport.

Numerous companies manufacture seating solutions that attempt to solve some of the problems listed above. Some of these are designed to provide more active seating and encourage movement for the user at both regular and standing height desks, and some are designed to provide seating options specifically for standing height desks. While they each have unique features and benefits, none of them provide a solution that is able to address all of the foregoing problems. In addition, none are designed to provide the type of exercise that the chair of the present disclosure provides. They also do not optimally allow desk workers to move easily between a wide variety of seated and standing positions so that they can be more active throughout the work day and thus mitigate some of the health risks associated with static sitting or standing for long periods of time. While many of these products are able to support you in a few different postures (e.g., sitting and standing, or sitting and leaning), none of them are able to support you in the full range of sitting, standing, perching, and leaning postures that the present disclosure provides.

Despite the foregoing efforts in the prior art, there is still a need to provide easy transitions between sitting and standing or between different ergonomic positions while seating. There is a demand for providing additional exercise benefit capabilities such as sit-up, back extension, and stretching exercises. There is a need for a foot rest that is more comfortably located in front of the chair for better ergonomics. There is also a need for adding multiple foot rests and a more ergonomic seat design that allow you to increase the range of healthy supported sitting positions available to the user and thus inspire movement between a variety of postures. This need includes adding foot rests that can be used while standing. This need also includes having a seat designed to allow the rotation of the pelvis in the anterior and posterior directions, with adjustable mechanical resistance. This provides significant musculoskeletal benefit to the spine by allowing movement and by making it easier to position the pelvis and back in healthy neutral ergonomic postures that reduce the strain on the spine and its supporting muscle groups. There is also still a need for a chair that is easy to store and carry. In conclusion, there is a need for all of the foregoing to be provided in one chair.

SUMMARY OF THE INVENTION

The present disclosure preserves the advantages of prior art chairs while providing new advantages not found in currently available chairs and overcomes many disadvantages of such currently available chairs. The present disclosure is generally directed to the novel and unique ergonomic standup chair that addresses all of the aforementioned problems associated with prior art chairs.

For example, in a preferred embodiment, the present disclosure provides a chair for standup use that can be folded for compact storage and transport while enabling in-place exercising. Further, the chair can be designed such that it can make easy transitions between sitting and standing or between different positions while seating.

A further object of the chair of the present disclosure is to include features that provide additional exercise and stretching capabilities such as sit-ups and back extensions. Accessories can be added to facilitate a full body workout.

Another object of the present invention is to provide a chair with both a foot rest that is more comfortably located in front of the chair for better ergonomics, and to provide multiple footrests to increase the variety of ergonomic sitting and standing positions that are available to the user.

Yet another object is to include foot rests that can be utilized while the user is standing to allow more ergonomic and dynamic standing positions.

A further object of the present invention to provide a chair that is easy to store and carry.

There is yet a further object of the present invention to provide a seat that allows adjustably dampened anterior and posterior pelvis rotation.

It is also an object to provide a seat pan that is optimally shaped to support the pelvis and spine in a wider range of healthy, ergonomic seated and leaning postures, and to support and inspire movement throughout the day.

BRIEF DESCRIPTION OF THE FIGURES

The novel features which are characteristic of the present disclosure are set forth in the appended claims. However, the invention's preferred embodiments, together with further objects and attendant advantages, will be best understood by reference to the following detailed description taken in connection with the accompanying drawings in which:

DETAILED DESCRIPTION OF THE INVENTION

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

Figure 1:
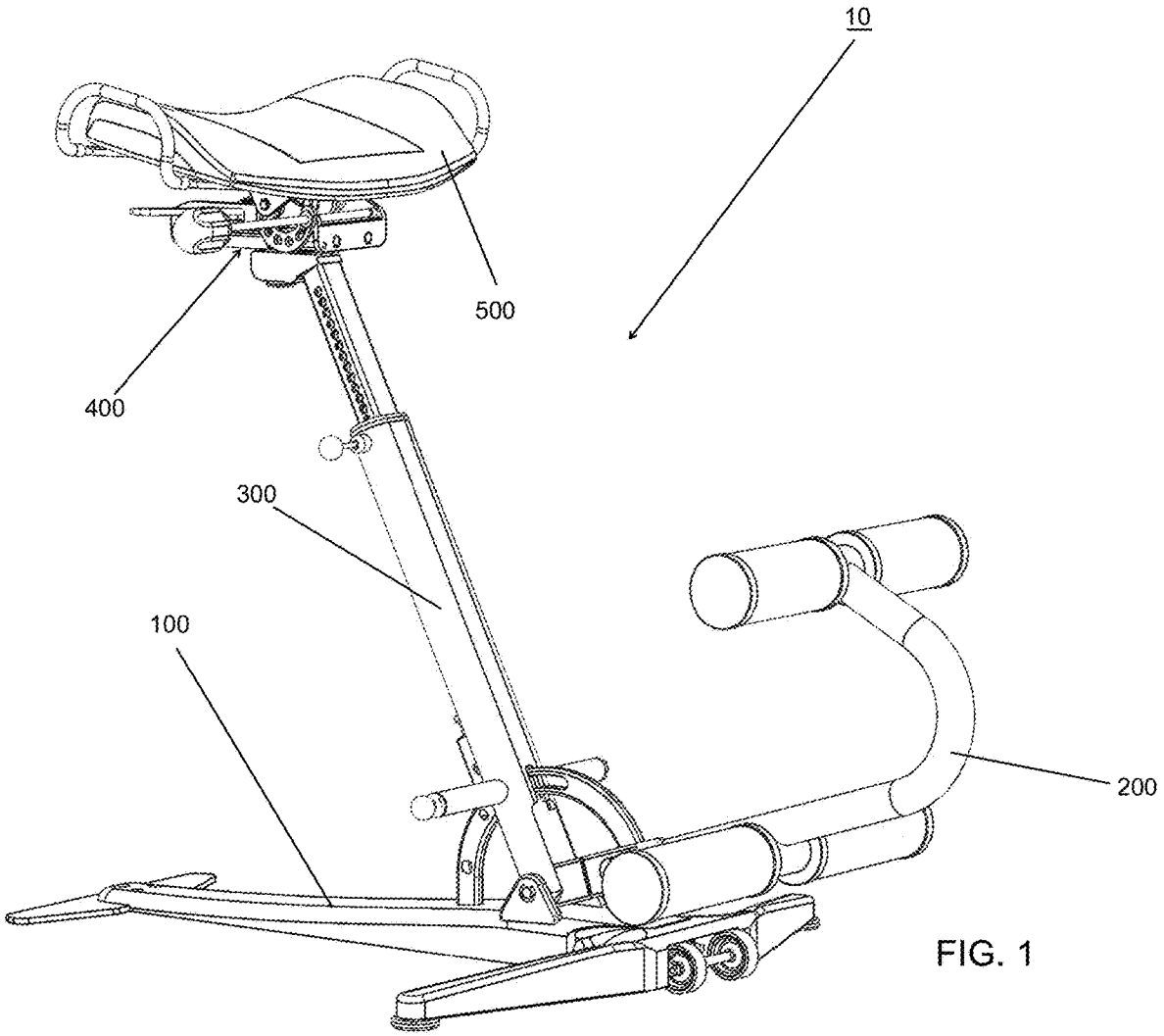
FIG. 1 shows a perspective view of an embodiment of the chair of the present invention.
Figure 2A:
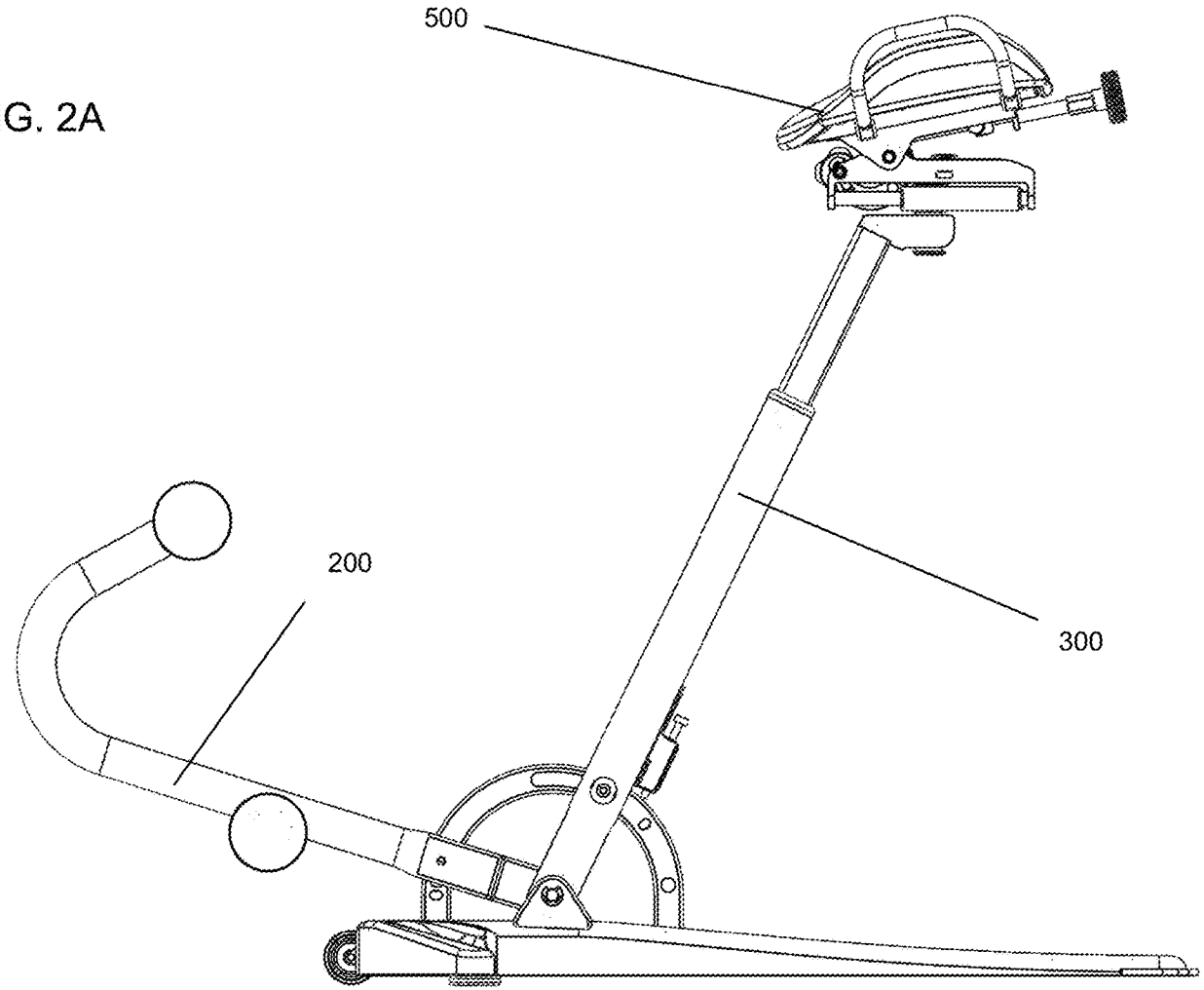
FIGS. 2A-2C shows side views of the chair of FIG. 1 in variety of configurations.
Figure 2B:
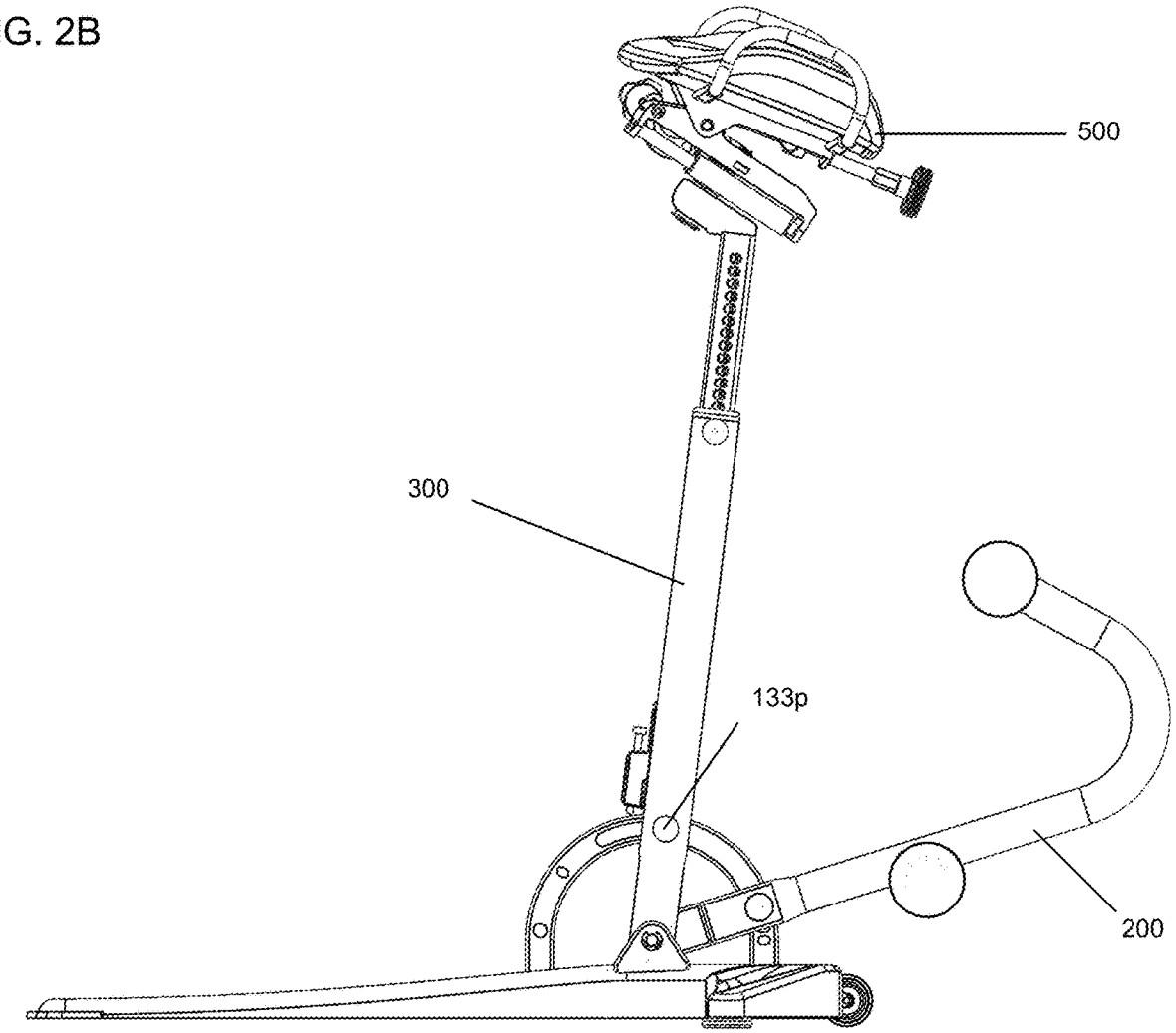
Figure 2C:
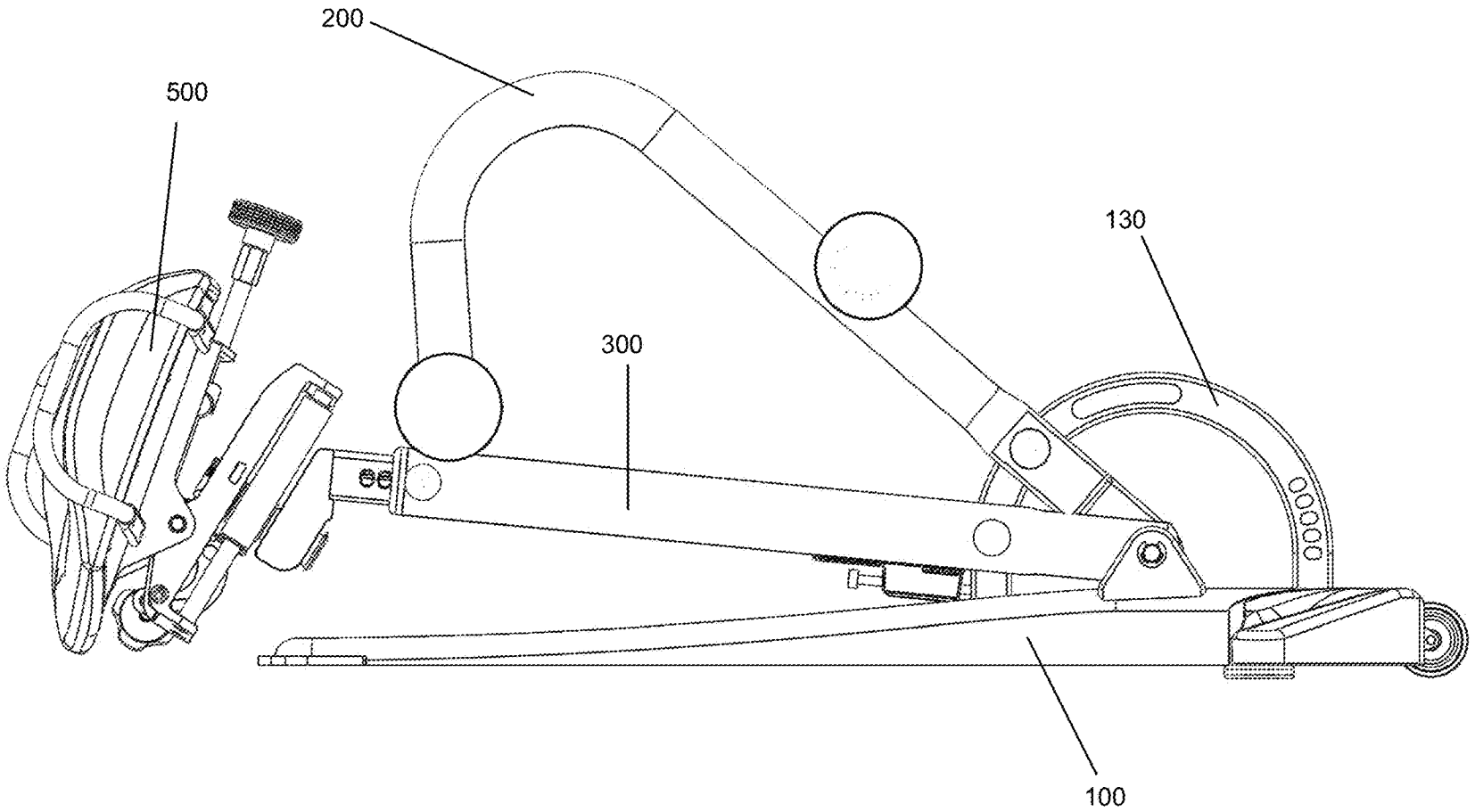

The chair 10 of the present disclosure, shown generally in FIG. 1, is intended to balance safety, comfort, ergonomics, numerous desk geometries, a variety of floor surfaces, the physics of cantilevered elements, the height of floor obstacles, and a large range of body types/sizes. It addresses the recommendations of ergonomic experts and adds the unique forward footrests and upper exercise bar that encourage movement and provide the capability to perform core workouts and other types of workouts. The entire chair 10 folds into a compact light weight package for easy transport and stowage, as shown in FIGS. 2A-2C.

The chair 10 of the present disclosure includes a number of subassemblies that interact to achieve the aforementioned benefits. For example, as shown in FIG. 1, the chair 10 can generally include a base 100 which supports the chair 10. The base 100 can pivotally receive a foot tube assembly 200 and a seat tube assembly 300. The foot tube assembly 200 and the seat tube assembly 300 can be pivotally connected to the base 100 to permit the chair to fold for easy transport and stowage. The seat tube assembly 300 can receive the seat adjustment assembly, or mechanism, 400 which can support the seat 500. The seat adjustment assembly 400 can allow for the seat to be adjusted in at least three degrees of freedom.

Figure 3:
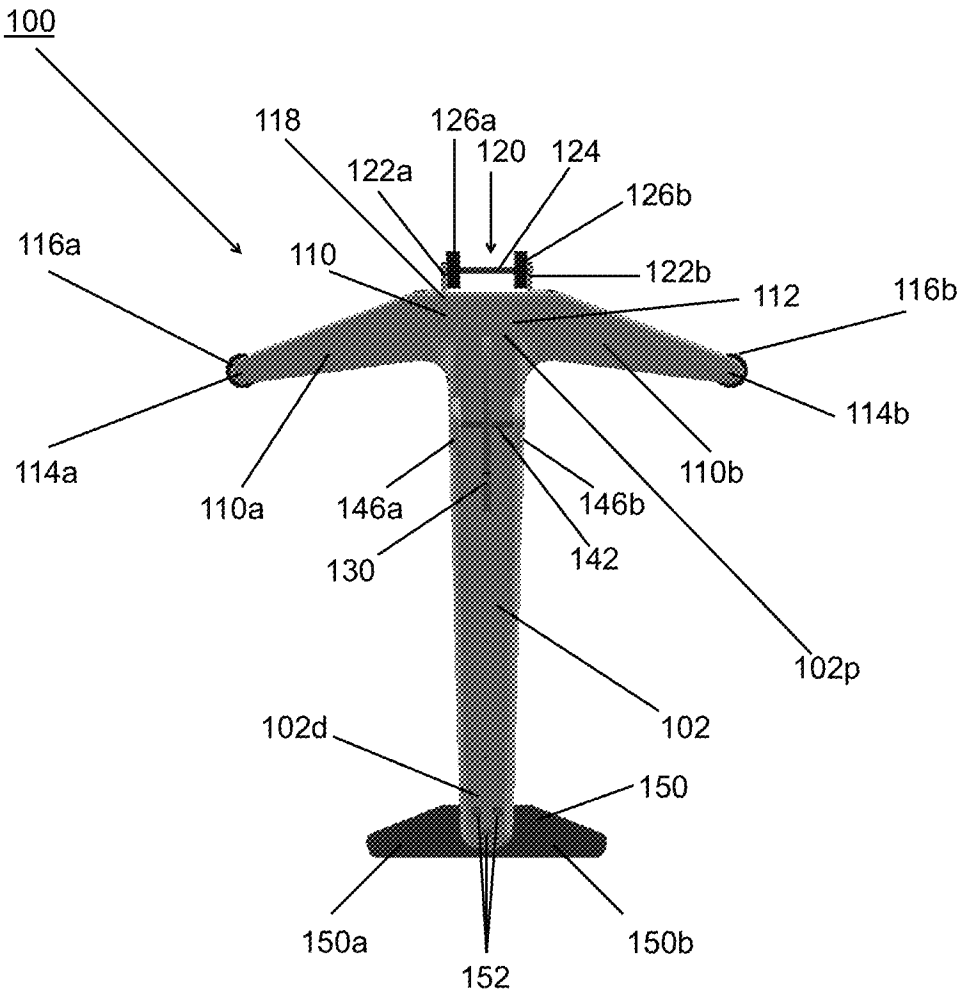
FIG. 3 is a top view of a base of the chair of FIG. 1.

The base assembly 100 can generally provide a cantilevered support a user sitting on the chair 10. The base assembly 100 can be manufactured from a plurality of parts, as illustrated, or can be manufactured from a single piece of material. In some embodiments, the base assembly 100 can be manufactured from metals, composite materials, plastics, wood, or a combination thereof. The base assembly 100 can be manufactured through stamping, molding, 3D printing or other manufacturing methods. The base assembly 100 can be made of four sub-assemblies, namely a center support 102, forward legs 110, a wheel assembly 120, and rear legs 150. In general, the center support 102 can include a proximal end 102*p* and a distal end 102*d*. The forward legs 110 can include a U-shaped cut out 112 which can receive the proximal end 102*p* of the center support. The proximal end of 102*p* of the center support 102 can be bolted to the forward legs 110, they can be welded together, or otherwise mechanically fixed relative to one another. The forward legs 110 can provide lateral support for the chair 10 as the two legs 110*a*, 110*b* extend from the central support 102. In the illustrated embodiment, as shown in FIG. 3, the legs 110*a*, 110*b* can be at a slight angle such that they slope towards the distal end 102*d* of the center support 102. In alternative embodiments, the legs 110*a*, 110*b* can extend generally perpendicular to the central support 102 or can be angled such that they slope away from the distal end 102*d* of the center support 102. At the respective ends 114*a*, 114*b* of the legs 110*a*, 110*b*, a foot 116*a*, 116*b* can be installed. The feet 116*a*, 116*b*, can extend from an underside of the ends 114*a*, 114*b*. In some embodiments, the feet 116*a*, 116*b* can be threaded into the underside of the ends 114*a*, 114*b* such that they can be adjusted to ensure that the legs 110*a*, 110*b* are stable during use. The forward legs 110 can alternatively be positioned and shaped to provide critical support needed for users who would like to work in supported ergonomic leaning or perching postures. The forward legs 110 can prevent a user's feet from uncomfortably sliding forward on the floor when trying to use the chair in this way. Without the forward legs 110 the strain required to resist the tremendous shear forces of the user's feet on the floor would make sitting in this position undesirable.

The forward legs 110 can additionally include a wheel assembly 120 disposed at a central forward location 118 of the forward legs 110. The wheel assembly 120 can generally include a U-shaped bracket 122 disposed in a groove, not shown, on an underside of the legs 100. The bracket 122 can include two laterally offset arms 122*a*, 122*b* which include through holes therein. A pin 124 can extend through the two through holes and be fixed therein. As shown, at least two wheels 126*a*, 126*b* can be rotatably disposed on the pin 124. The wheels 126*a*, 126*b* can permit the chair 10 to be rolled across a surface when the chair 10 is pivoted upward about the pin 124.

Returning to the center support 102, a rear stability plate, or legs, 150 can be disposed at the distal end 102*d* of the center support 102. A lower face of the distal end 102*d* of the center support 102 can rest on top of the rear stability plate 150. In the illustrated embodiment, two rear legs 150*a*, 150*b*, can extend on either side having a generally right triangular shape. The rear stability plate can, as illustrated, be secured to the center support 102 with a plurality of screws 152. Alternatively, the rear plate can be welded or otherwise secured to the center support 102. The rear support plate 150 can additionally provide lateral support for the chair 10.

At a forward, or proximal, position on the center support 102, a pivot pin assembly 140 can be disposed on a top surface. The location of the pivot pin assembly 140 can be chosen to ensure that a proper balance is achieved when a user is seated on the chair 10. The location of the pivot pin assembly 140 can be chosen to ensure that the center of gravity of a user can stay within a safe operating envelope of the base 100 to ensure that the chair 10 remains in stable operation. The pivot pin assembly 140 can pivotally secure the foot tube 200 and seat tube 300 to the base 100. A pivot pin 142 can be disposed in through holes 144*a*, 144*b* respectively disposed through ears 146*a*, 146*b*. The ears 146*a*, 146*b* can be welded, or otherwise secured, onto the center support 102. In the illustrated embodiment, the ears can have a generally triangular shape with a rounded top apex. The pivot pin 142 can be secured within the ears using c-clips 148*a*, 148*b* secured about the ends of the pivot pins on an outer surface of the ears 146*a*, 146*b* as shown in at least FIGS. 4 and 5. The foot tube 200 and seat tube 300 can be inserted into the open space between the ears 146*a*, 146*b* before the pin 142 is inserted into the ears.

Figure 4:
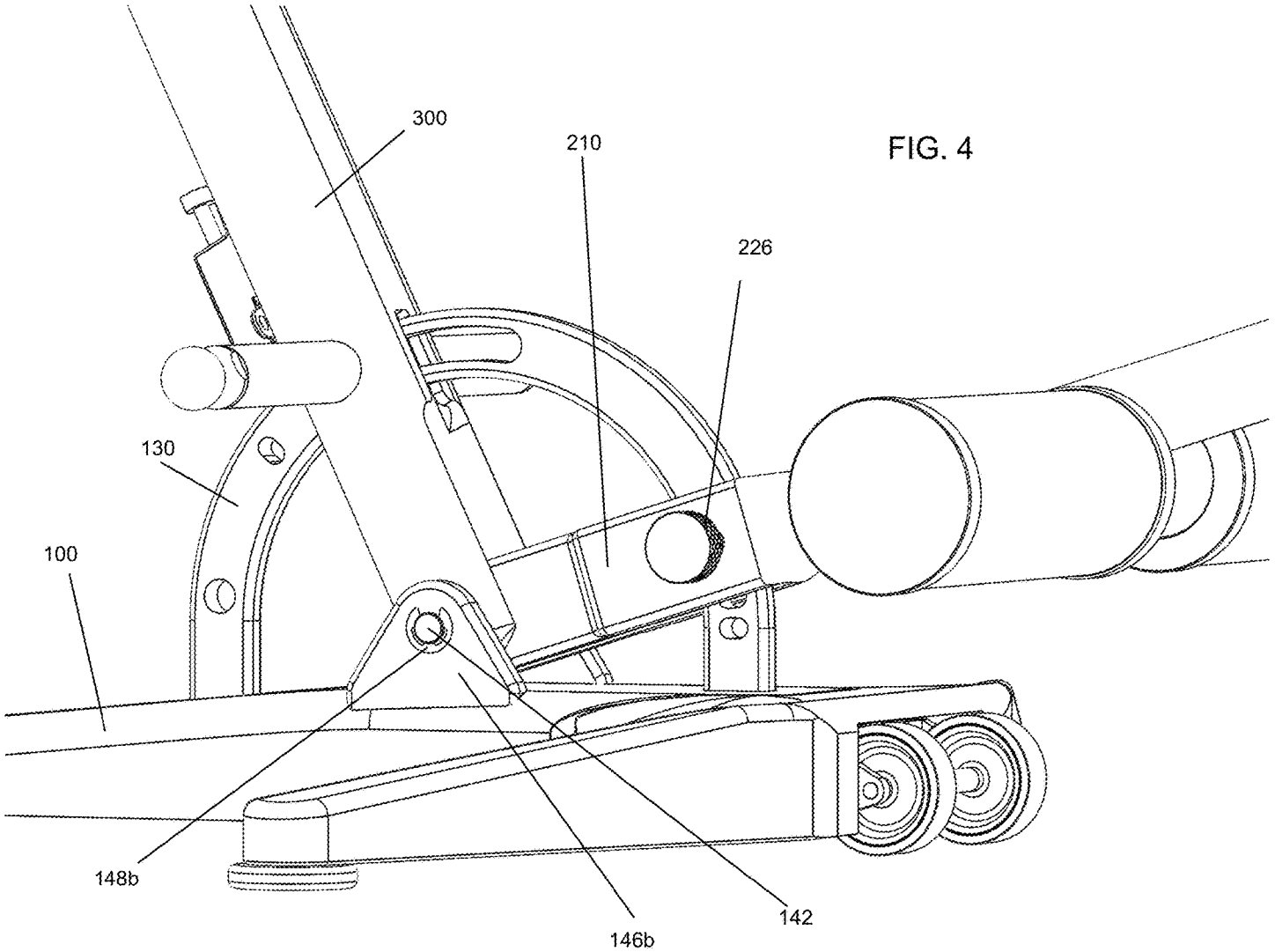
FIG. 4 is a partial perspective view of the chair of FIG. 1.
Figure 5:
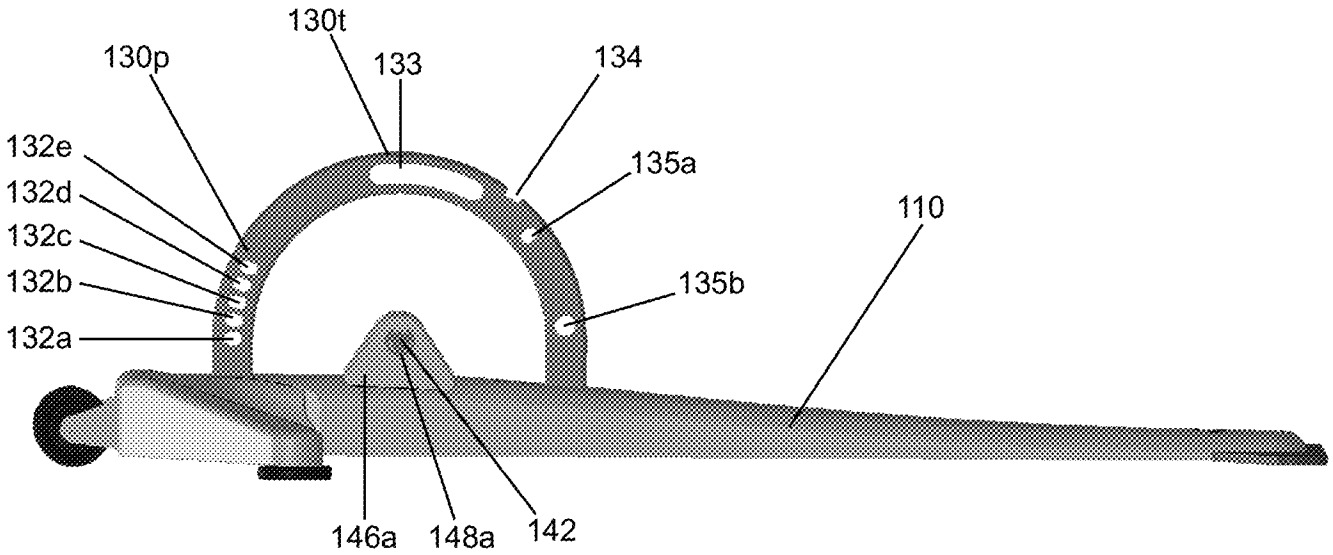
FIG. 5 is a side view of the base of the chair of FIG. 1.

In addition to the pivot pin assembly 140 supporting the foot tube 200 and the seat tube 300, a positioning arc 130 can be additionally disposed on the top surface 102*t* of the center support 102. The positioning arc 130 can be generally centered over the ears 146*a*, 146*b*, as shown in FIGS. 2A-2C. In the illustrated embodiment, the arc 130 can be an upside down U-shape or circular arc shape. The arc 130 can be welded or bolted to the center support 102. The rotational positions of the foot tube 200 and the seat tube 300 can be fixed relative to the arc 130 by the insertion of pins into various through holes, notches, and arcs, as shown in one configuration in FIG. 4 and discussed further below. As illustrated in FIG. 5, a first set of through holes 132*a*-132*e* can be disposed on a proximal portion 130*p* of the arc 130. These first set of through holes 132*a*-132*e* can be used to fix the rotational location of the foot tube 200 or the seat tube 300 when the seat is in an open, unfolded, configuration, as will be discussed further below. A through hole in the shape of an arc 133 can be disposed proximate the top 130*t*, or keystone, of the arc extending distally towards the distal end 130*d* of the arc. The length of the arc 130 can permit the seat tube to translate within the arc 130 from a standing desk orientation, as shown in FIG. 2A, to an orientation suitable for a standard desk, as shown in FIG. 2B. At the distal end of the arc through hole 133, a notch 134 can be disposed on the top surface of the arc 130. In the distal end 130*d* of the arc, two additional through holes 135*a*, 135*b* can be located to secure the foot tube 200 and seat tube 300 when the chair is in a collapsed configuration. Alternatively, any number of notches, through holes, or through arcs can be made in the arc 130 to achieve a particular ergonomic need for the end user.

Figure 6:
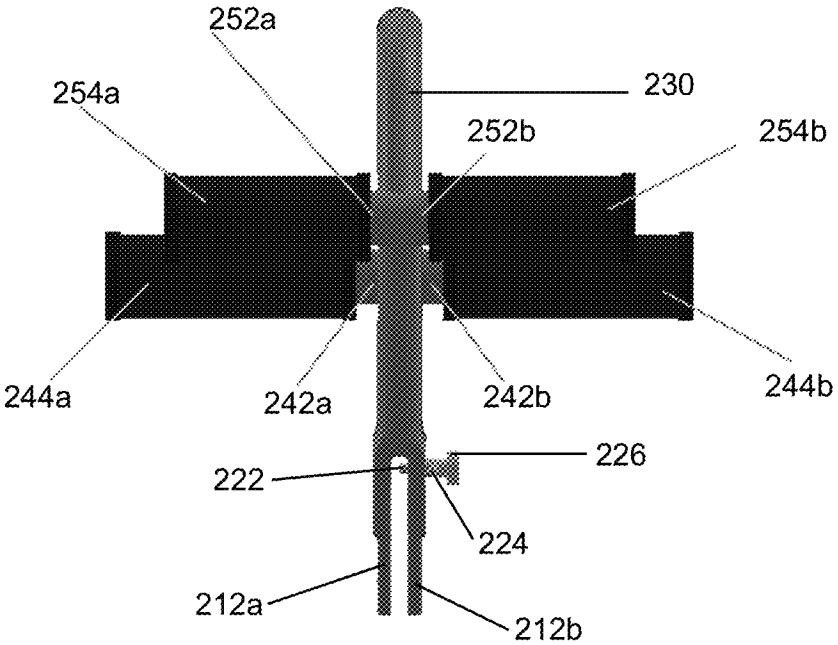
FIG. 6 is a top view of the foot rest assembly of the chair of FIG. 1.

As noted above and shown for example in FIG. 4, the foot tube assembly 200 can be pivotally attached to the base assembly 100 to allow for the foot rests to be disposed in a number of different positions. The foot tube 200 assembly can generally include a forked arm 210 received within a hook shaped tube 230. The hook shaped tube 230 can have two sets of foot rests 244, 254 disposed thereon. Alternatively, the foot tube assembly 200 can include any number of foot rests. The foot tube assembly 200 can be manufactured from any different material having suitable strength to support the weight of an adult, for example metals, plastics, wood, and composite material, or a combination thereof. The forked arm 210 can generally include two forked arms 212*a*, 212*b* extending from a support tube 216 creating a generally U-shape. The two forked arms can be separated by a distance that is approximately larger than the width of the arc 130 such that they can be disposed on either side of the arc 130. At a proximal end of the forks 212*a*, 212*b*, a pivot pin through hole 213*a*, 213*b* can be coaxially arranged. The pivot pin through holes 213*a*, 213*b* can have a diameter sized to receive the pivot pin 142 to be pivotally supported by the base 100. At a location distal to the pivot pin through holes 213*a*, 213*b*, the forks 212*a*, 212*b* can include locking pin through holes 214*a*, 214*b*. In the illustrated embodiment, as shown in FIGS. 4 and 6, the locking pin through holes 214*a*, 214*b* can be threaded to receive a threaded locking pin 220. The threaded locking holes 214*a*, 214*b* can be located on the forks 212*a*, 212*b* such that they are aligned with the various through holes 132*a*-132*e*, 135*a*, 135*b* on the arc 130 when the foot tube 200 is installed onto the pivot pin 142. When the locking holes 214*a*, 214*b* are coaxially aligned with one of the arc through holes 132*a*-132*e*, 135*a*, 135*b*, the threaded locking pin 220 can be disposed through the locking holes 214*a*, 214*b* and the respective arc through hole 132*a*-132*e*, 135*a*, 135*b* to fix the rotational location of the foot tube 200. The threaded locking pin 220 can include a pin portion 222, a threaded portion 224, and a knurled head 226. In use, the pin portion 222 can be inserted first through the locking through hole 214*a* until the threaded portion 224 engage the threaded locking hole 214*a*. The locking pin 220 can be threaded through both an arc through hole 132*a*-132*e*, 135*a*, 135*b* and then into the other foot tube through hole 214*b* and advanced into a locked configuration as the threads 224 engage the threads, not shown, in the threaded through hole 214*a*. The knurled head 226 can be textured, or knurled, to provide the user with added grip. In an alternative embodiment, the locking pin 220 can be spring loaded to bias the pin into a locking engagement with the arc through hole 132*a*-132*e*, 135*a*, 135*b* and the other of tube locking through hole 214*b*.

Figure 7:
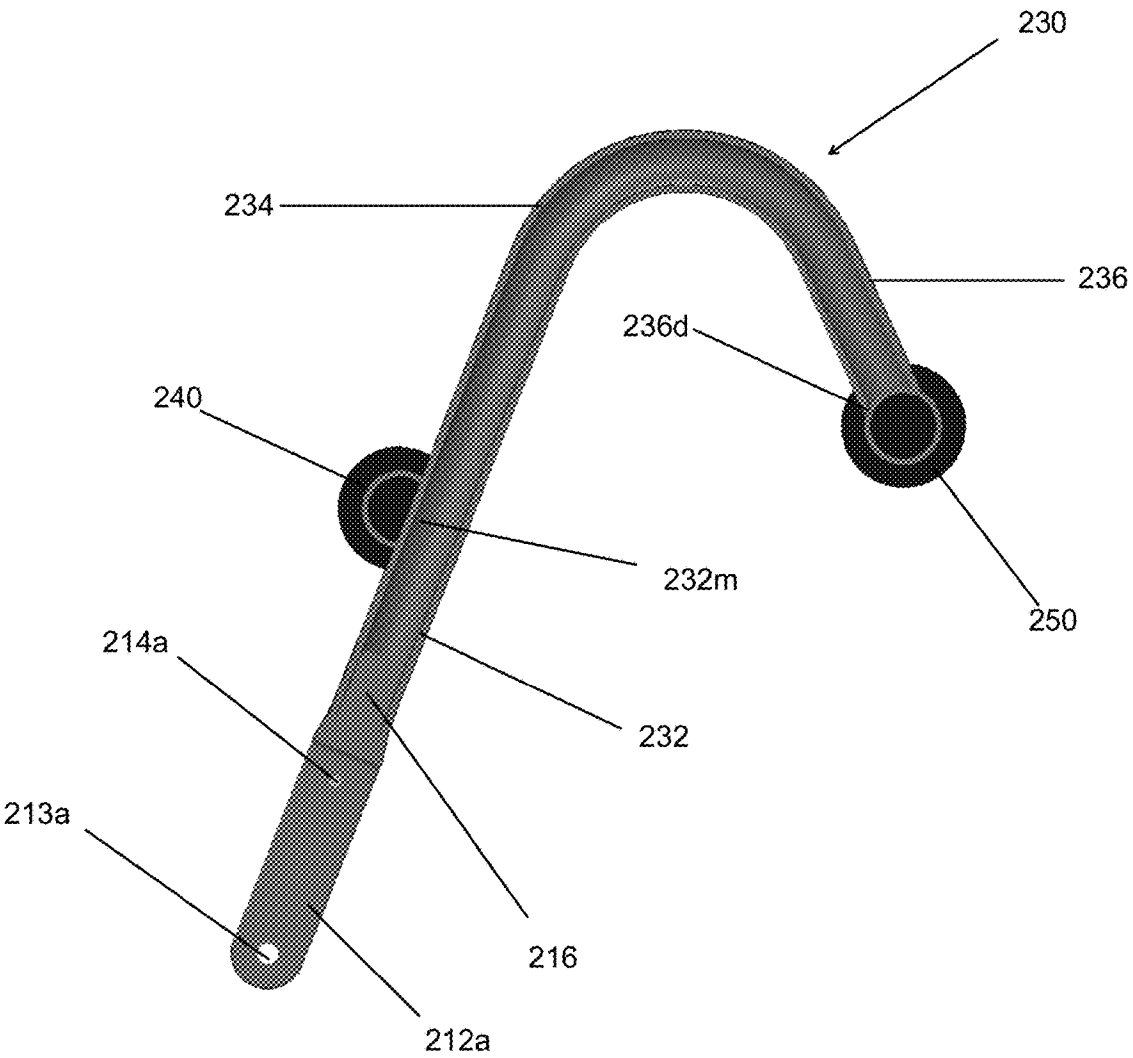
FIG. 7 is a side view of the foot rest assembly of FIG. 6.
Figure 8:
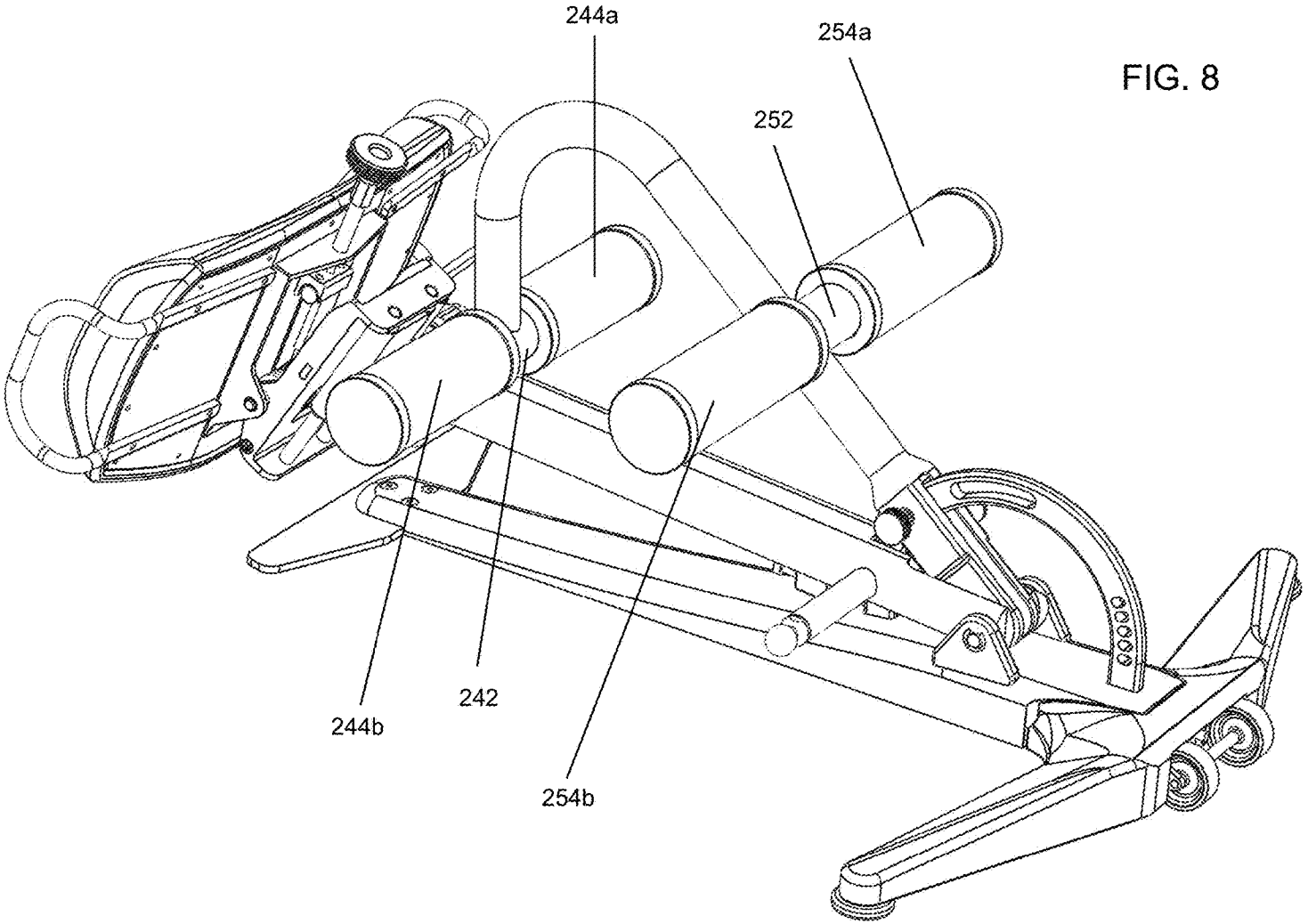
FIG. 8 is a perspective view of the chair of FIG. 1 in a collapsed configuration.
Figure 9:
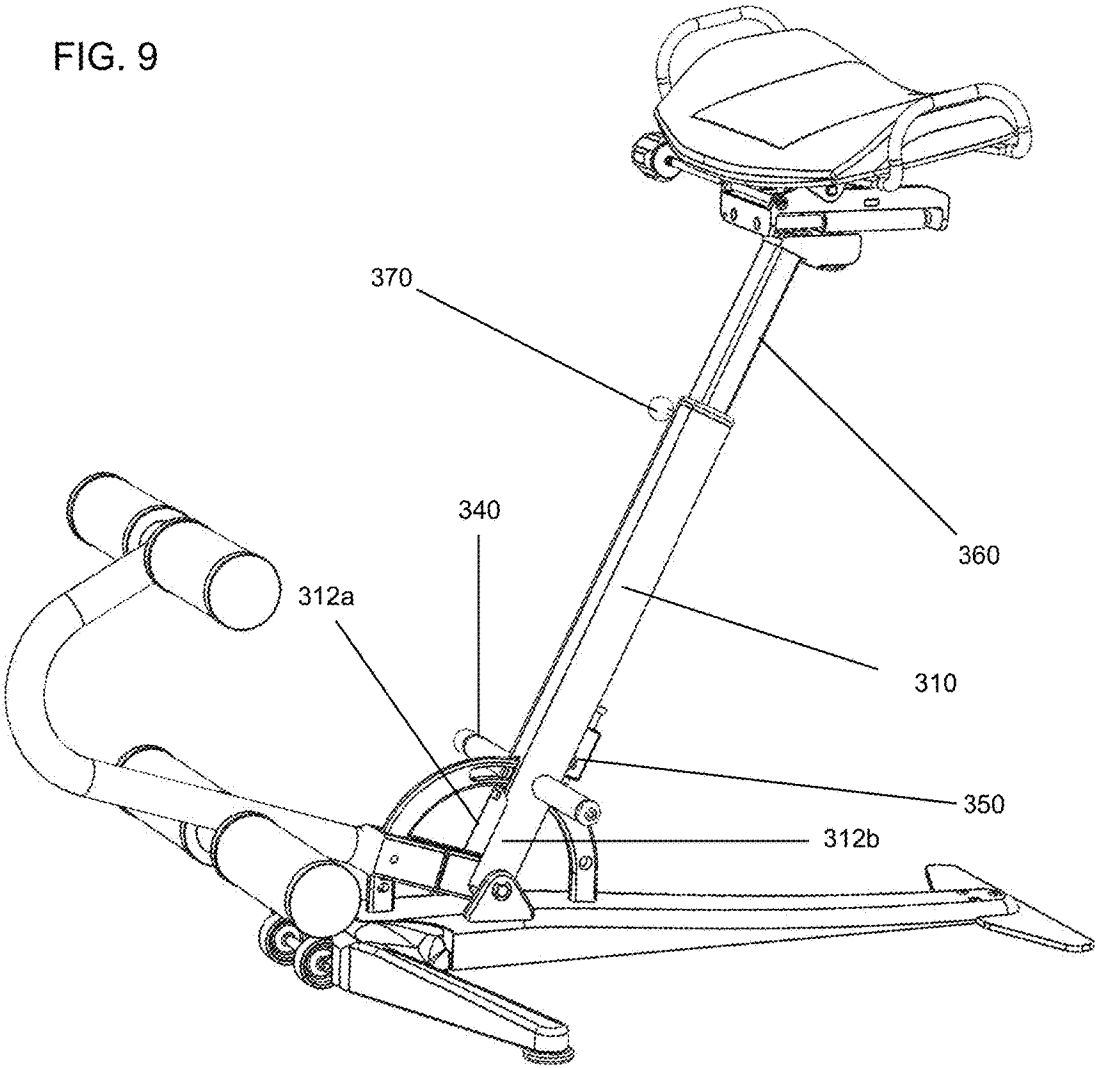
FIG. 9 is a perspective view of the chair of FIG. 1
Figure 10:
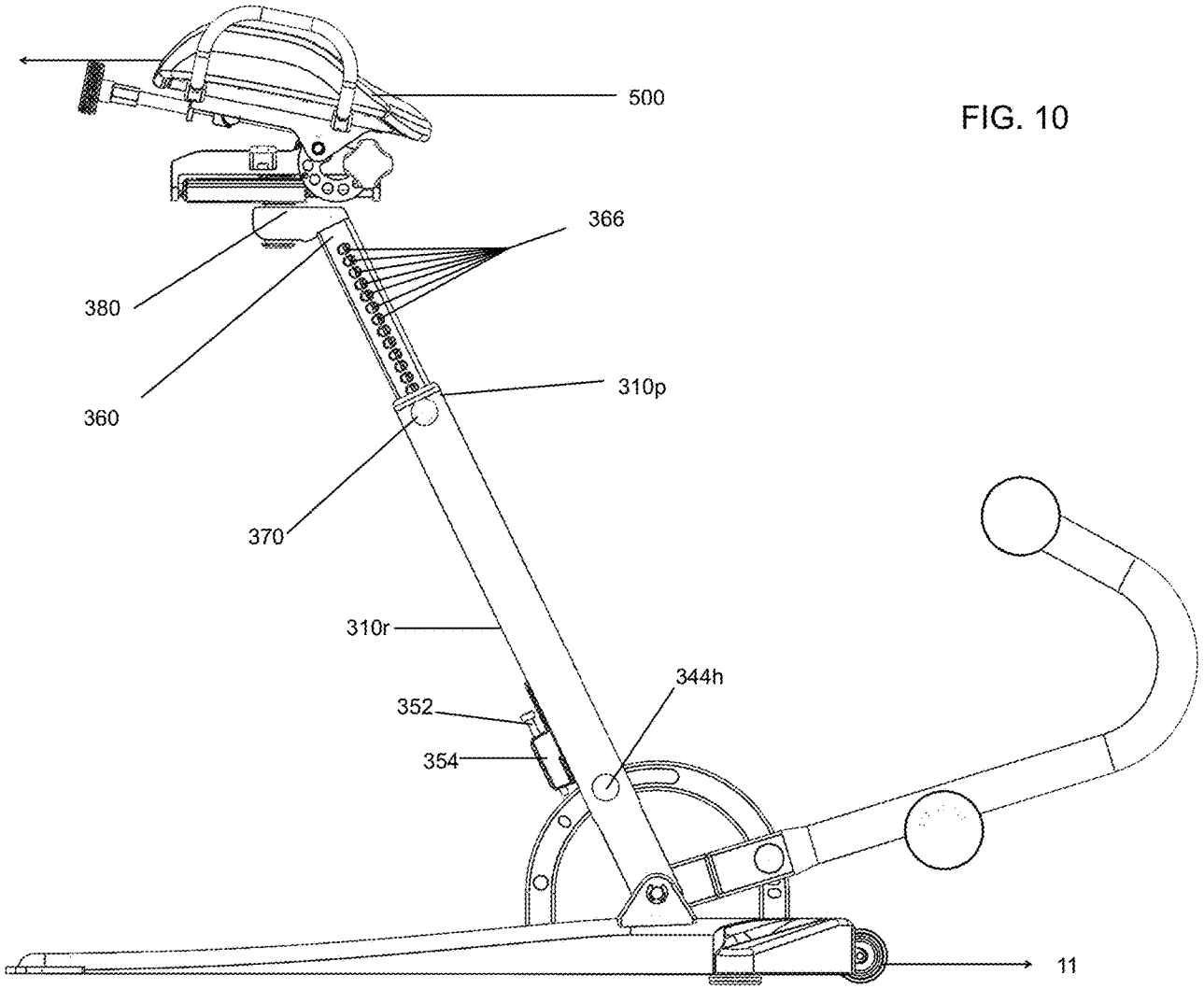
FIG. 10 is a side elevation view of the chair of FIG. 1.

At the distal end of the fork portion 210 a support tube 216 can extend distally having a diameter D1. The support tube 216 can have a generally circular cross-sectional shape. In alternative embodiments, the support tube 216 can have any cross-sectional shape. The support tube 216 can be telescopically received within the hook portion 230, as shown in FIG. 7. The support tube 216 and the hook portion 230 can be welded, riveted, or otherwise mechanically fixed together. In an alternative embodiment, the hook portion 230 can be received within the support tube 216.

Figure 21:
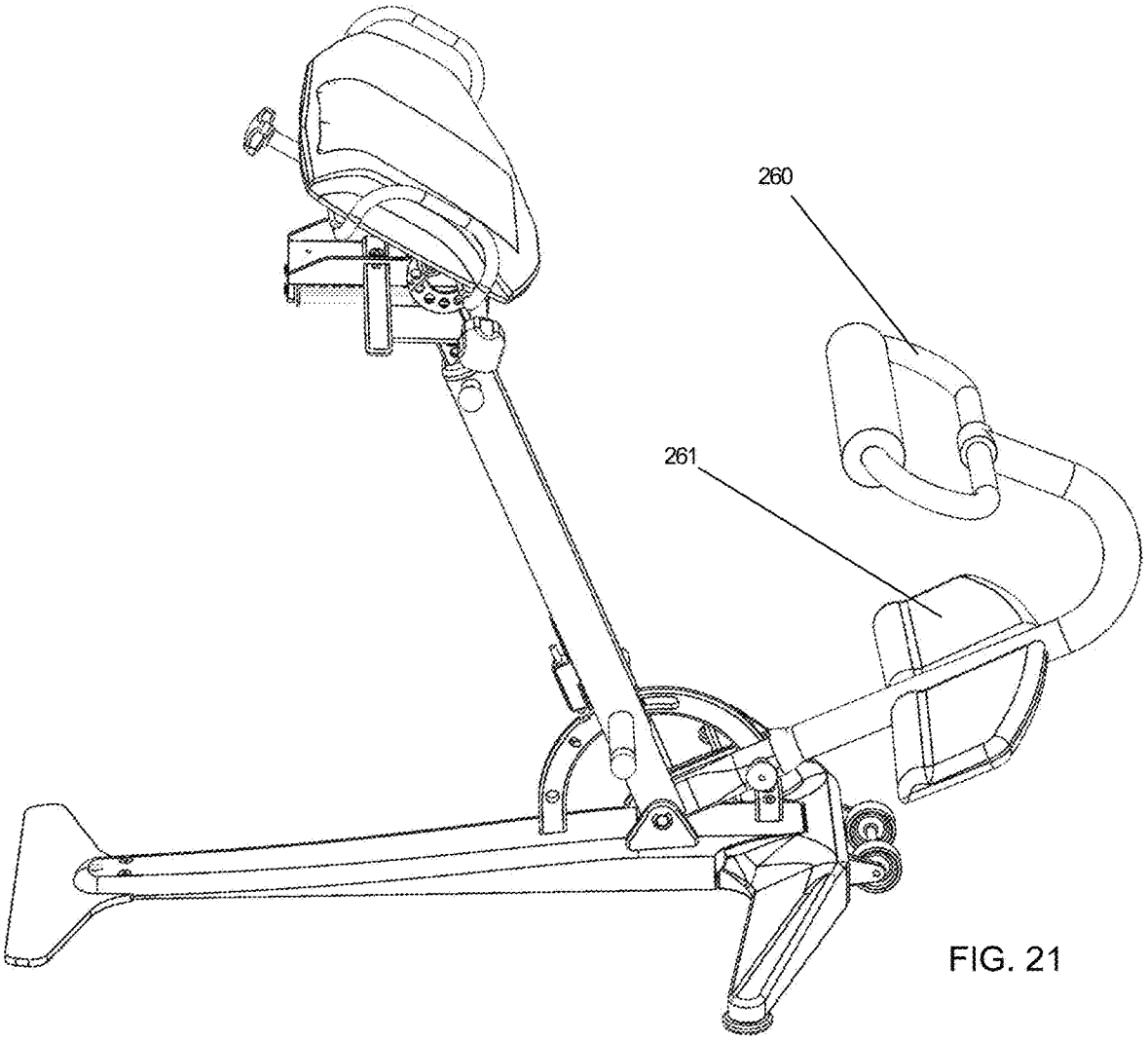
FIG. 21 is an isometric view of an alternative chair with a lower foot platform and upper loop foot restraint.

The hook portion, as shown in FIG. 7, can include a first, proximal, straight section 232 which leads to a curved, or hooked, section 234, and can end with a second, distal straight section 236. The hook portion 230 can be a hollow shaped tube having a generally circular cross-section. In alternative embodiments, the hook portion 230 can be solid and have any cross-sectional shape that may receive the support tube 216 of the fork portion 210. At a medial location 232*m* of the first section 232 a first foot rest 240 can be disposed. In alternative embodiments, the first foot rest 240 can be disposed at other locations on the foot tube 200. The term "foot rest" can include any of a tube, a tube with foam, a cross bar, platforms, rigid loops, straps, or other structure to support a portion of a user. The first foot rest 240 can include a tube 242 having two sides 242*a*, 242*b* on either side of the first section 232. The two sides 242*a*, 242*b* can each have foam tubes 244*a*, 244*b* disposed thereon. The foam tubes 244*a*, 244*b* can advantageously provide for an added level of comfort for when the user is in contact with the first foot rest 240. Alternatively, the foam tubes 244*a*, 244*b* can be tubes made from other materials. In a further alternative embodiment, the foot rests 240, 250 can be any of a cross-bar, platform, loop, or other forms of foot restraints. In an alternative embodiment, as shown in FIG. 21, in place of the first foot rest 240, a platform 261 can be disposed on either side of the foot tube 200. The platform 261 can be an ergonomically shaped platform made from wood, plastic, metal, or a combination thereof. In some embodiments, the platform 261 can have a layer of foam or other materials layered on top for added comfort.

As shown in FIG. 7, at a distal location 236*d* of the second straight section 236 a second foot rest 250 can be disposed. In alternative embodiments, the second foot rest 250 can be disposed at other locations on the foot tube 200. The second foot rest 250 can include a tube 252 having two sides 252*a*, 252*b* on either side of the second section 236. The two sides 252*a*, 252*b* can each have foam tubes 254*a*, 254*b* disposed thereon. The foam tubes 254*a*, 254*b* can advantageously provide for an added level of comfort for when the user is in contact with the first foot rest 240. Alternatively, the foam tubes 254*a*, 254*b* can be tubes made from other materials including wood or plastics. In an alternative embodiment, as shown in FIG. 21, the second foot rest 250 can be in the form of an exercise bar 260. The exercise bar 260 may be an aluminum loop with foam padding which provides the user with more secure support when stretching or doing sit-ups since it allows a user to lock your feet into it. Not shown, either of the first or second foot rests 240, 250 can be any of a foot rest, platform, exercise bar, loop, or other forms of foot restrains in any combination. The foot rest 240 can be positioned to support the user in ergonomic seated postures and stretching exercises. The foot rest 250 can be positioned to additionally support the user in ergonomic seated postures, but also is correctly placed to support the users legs when doing a sit-up.

In addition to the foot tube 200 providing support for a user, a seat 500 is pivotally connected to the base 100. The seat 500 rests upon an adjustable seat tube, or post, 300 that is pivotally receives the pivot pin 142. The seat tube 300 can be manufactured from any different material having suitable strength to support the weight of an adult, for example metals, plastics, wood, and composite material, or a combination thereof. In general, the seat tube can be a height adjustable assembly made from a tube 310 and an inner tube 360. The tube 310 can have a generally rectangular, or square, or circular cross-section having a lumen 311 extending from a proximal most end 310*p* to a distal most end 310*d*. At the distal end of the tube 310 can have a fork structure 312 extending distally therefrom. Forks 312*a*, 312*b* can be laterally disposed from one another a first distance D1. The first distance D1 is sized to receive both fork 212 of the foot tube therein such that the fork tube can rotate, or pivot, about the pin 142 concurrently with the seat tube 300. At a distal end 312*d* of the forks, there are respective pivot through holes 313*a*, 313*b* for receiving the pivot pin 142. During construction of the chair 10, the fork 312 can be inserted between the ears 146*a*, 146*b*, and the fork 212 can be disposed between the forks 312*a*, 312*b* such that the respective pivot through holes of the forks 212, 312, and the ears 146*a*, 146*b* are coaxially aligned to receive the pivot pin 142. An upper U-shaped opening can extend proximally from where the forks extend thereby defining an opening with a second distance D2. The second distance D2 can be sized to slidably receive the arc 130. At the same height of the U-shaped opening, a support and locking assembly can be disposed within the interior lumen 311 of the tube 310.

The support, or seat tube reinforcement block 330, can be telescopically received in the lumen 311 to provide additional structural support for the seat tube 300. The support 330 can be manufactured from a urethane, metal, or composite materials. The support 330 can be generally cylindrical having a corresponding opening to the opening of the tube 310. When installed within the lumen 311 of the tube 310, the opening 332 of the support 330 can be aligned with the opening of the tube 310 to receive the arc 130. The bottom surface of the opening can ride, or contact, the upper surface of the arc 130. In the illustrated embodiment, the support 330 is retained within the lumen 311 with a screw 334 inserted into the rear face 310*r* of the tube 310. Alternatively, the support 330 can be glued, welded, or otherwise retained in the lumen 311 to prevent the support 330 from migrating, or moving, within the lumen 311.

A stop pin assembly 340 can be disposed at the distal end 310*d* of the tube 310. The stop pin assembly 340 can extend perpendicularly to tube 310, substantially at the location of the openings 314, 332. On either side of the tube 310, two stop pin housings 342*a*, 342*b* can house the stop pin 344, biasing spring 345 and retaining screws 346*a*, 346*b*. The retaining screws 346*a*, 346*b* can have one end threaded on to the respective housings 342*a*, 342*b* and the opposite end threaded into the tube 310 and support 330 to retain the housings 342 on the tube 310. A pin 344 can extend in the housing 342*a*. The pin 344 can have a head 344*h* disposed outside the housing 324*a*. The stop pin assembly 340 can additionally include a compression spring 345 to bias the tip of pin 344*t* through the openings of the arc 130. The pin can have a stop 344*s* that can abut an end of the retaining screw 346*a* to prevent the pin from over extending into the housing 342*a*. The head 344*h* can be grasped by a user to withdraw the pin 344 from engagement with the various through holes and arc holes 132*a*-132*e*, 133, 135*a*, 135*b* of the arc 130. In use, the head 344*h* can be pulled away from the arc 130 to remove the pin 344 from engagement with the arc 130. Once the preferred location of the seat tube 300 is attained, the user can release the head 344*h* and the spring 345 can bias the pin 344 back into engagement. Alternatively, other stop mechanisms can be used to retain the rotational configuration of the seat tube 300 relative to the arc 130. In use, the housing 342*a*, 342*b* can serve as additional footrests that may be used by the user while sitting or standing. Further, the housings 342*a*, 342*b* can be used as a step to aid a user when they are getting onto the seat 500.

An additional retaining mechanism 350 in the form of a stop pin 352 can be disposed on the rear face 310*r* of the tube 310 in a rear housing 354. In an exemplary embodiment, the rear housing 354 can be welded or screwed onto the rear face 310*r* of the tube 310. The rear housing 354 can have a through hole 356 which can slidably receive a stop pin 352. In some embodiments the stop pin 352 can be a cylindrical pin, a bar, or other shapes. The stop pin 352 can be sized to be received within the notch 134 of the arc 130 to prevent the tube 310 from over rotating towards the distal end 130*d* of the arc 130. In some embodiments, the retaining mechanism 350 may not be included.

As noted above, the proximal end of the tube 310*p* can be open to telescopically receive an inner tube 360 which supports a seat adjustment, or rod, assembly 400 and a seat 500. The inner tube 360 can have a generally rectangular, trapezoidal, square, or circular cross-section that matches the cross-section of the inner lumen 311 of the tube 310. In some embodiments, the external cross-sectional shape of the tube 310 can be different than the internal cross-sectional shape of the lumen 311. The cross-sectional shapes of the inner tube 360 and the lumen 311 may be chosen to prevent the inner tube 360 from rotating within and relative to the tube 310. Along the length of the inner tube 360, a series of through holes 362 can be made through at least one face of the inner tube 360. In an alternative embodiment, the through holes 362 can extend from one face of the inner tube 360 to another face of the inner tube. The through holes 362 can be made at any desirable interval. The interval, or distance between the holes can provide for added granularity in adjustment of the relative height of the inner tube 360 to the tube 310. As the seat 500 is fixed to the proximal end 360*p* of the inner tube 360, the height of the seat 500 can be adjusted as the inner tube 360 is moved within the tube 310.

The relative height of the inner tube 360 can be locked with respect to the tube 310 with a height locking pin 370. As illustrated, the height locking pin can be disposed at the proximal end of the tube 310. The height locking pin 370 can be disposed in a housing 372 which houses the pin 370 and a biasing spring, not shown. The biasing spring can bias the pin 370 in a direction towards the inner tube 360. In use, the pin can be withdrawn, away from the inner tube 360 to allow the inner tube to slide within the tube 310 to adjust the height of the seat 500. Once the desired height is achieved, the pin 370 can be release and biased into engagement with one of the through holes 362 in the inner tube 360.

Figure 11:
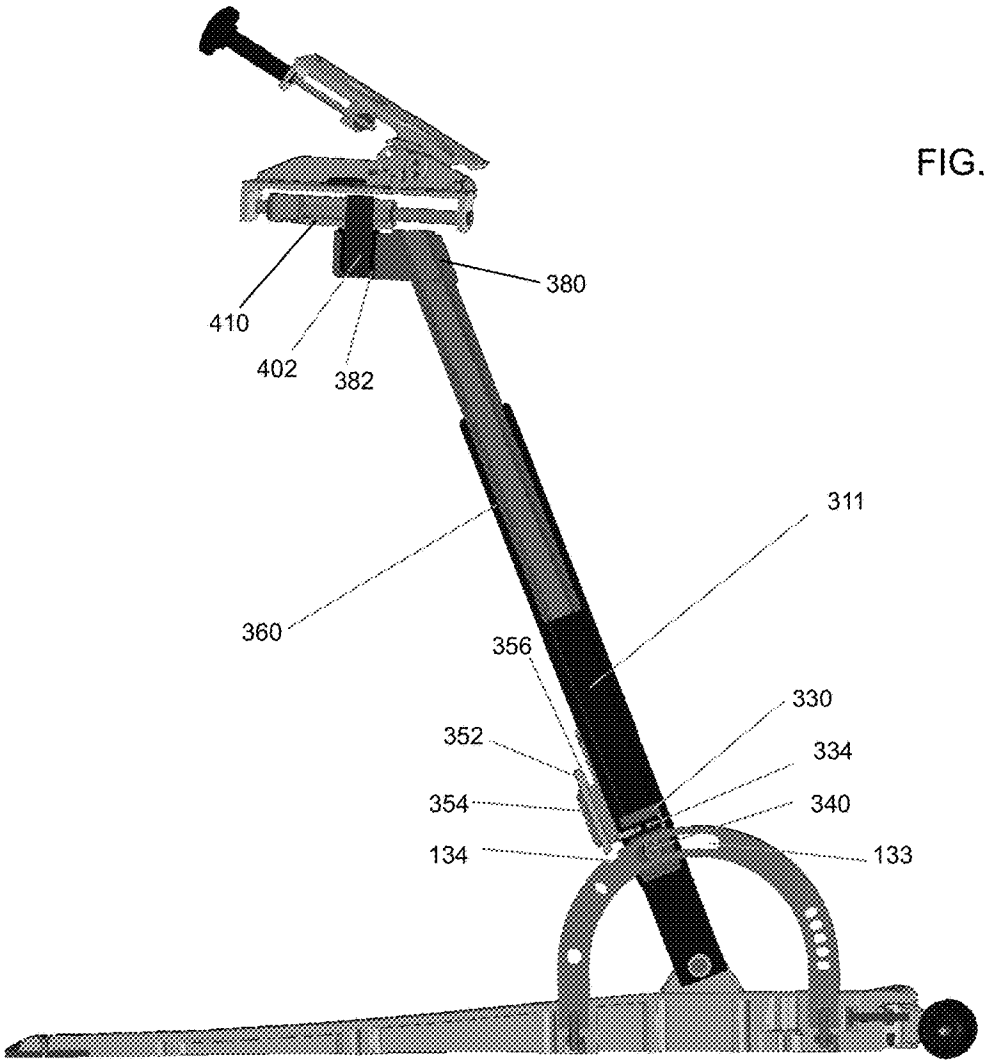
FIG. 11 is a cross-sectional view of FIG. 11.
Figure 12:
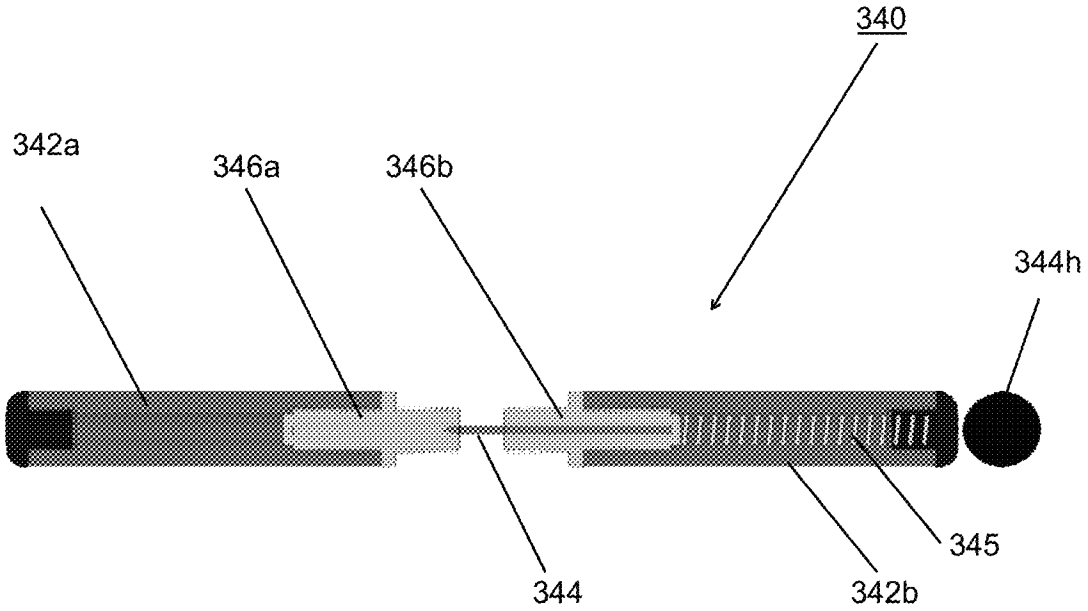
FIG. 12 is a cross sectional view of the locking pin of the seat post of the chair of FIG. 1.
Figure 13:
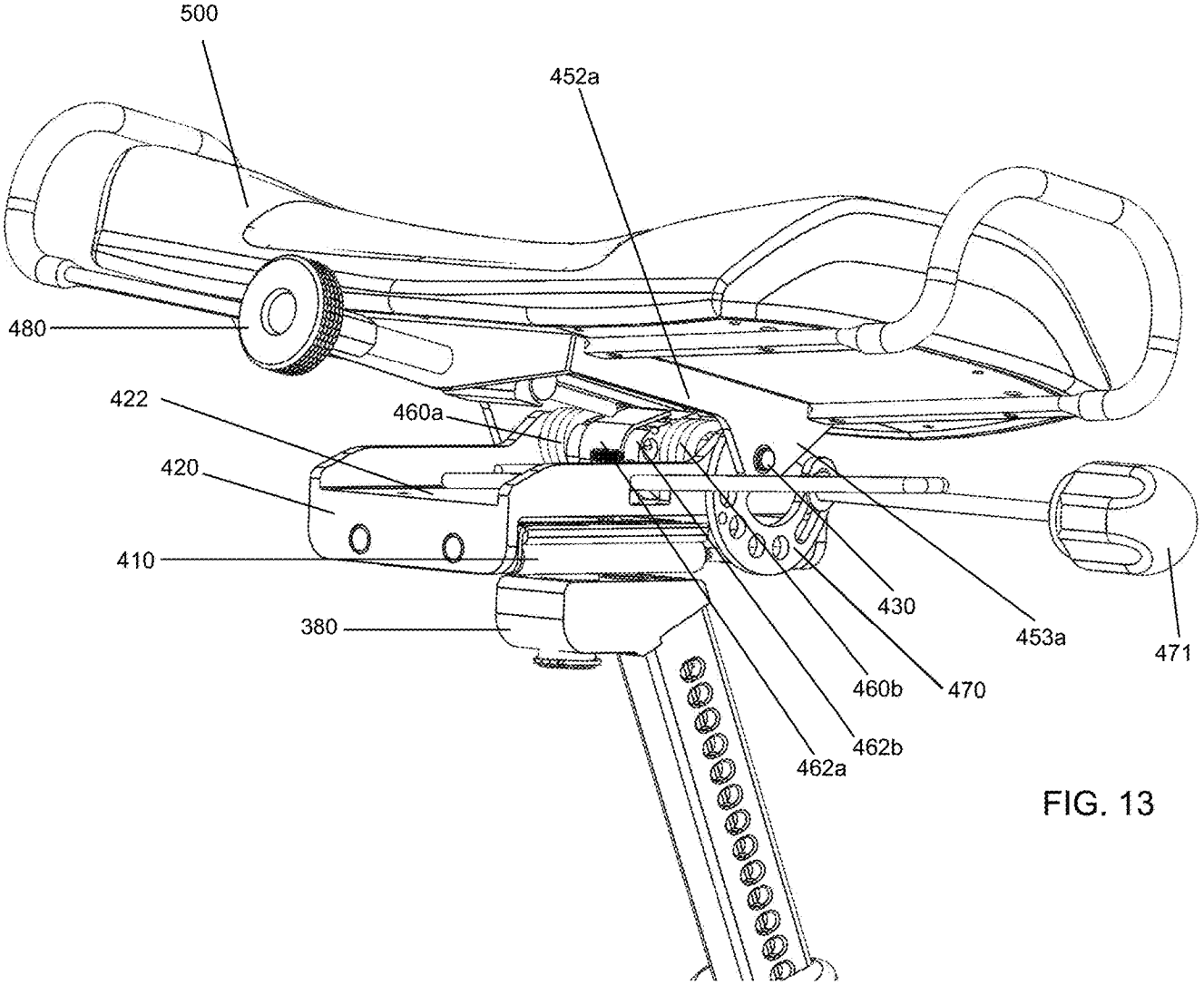
FIG. 13 is a bottom perspective view of the seat of the chair of FIG. 1.

Returning to the inner tube 311, a seat tube adapter 380 can be disposed on a distal most end 311*d* of the inner tube 311. The seat tube adapter 380 can provide a support to receive the seat adjustment mechanism 400. The seat tube adapter 380 can telescopically receive the distal end 311*d* of the inner tube 311 at a forward end thereof, as shown in FIG. 11. In some embodiments, the seat tube adapter 380 can be welded or otherwise mechanically secured to the inner tube 311. Further, the seat tube adapter 380 can have a cylindrical through hole 382 at a rear end thereof. The cylindrical through hole 382 can receive a yaw pin 402 of the seat adjustment mechanism 400. When the yaw pin 402 is received within the through hole 382, the seat adjustment mechanism can rotate within the through hole to provide a first degree of freedom, or adjustment for the seat 500.

Figure 16:
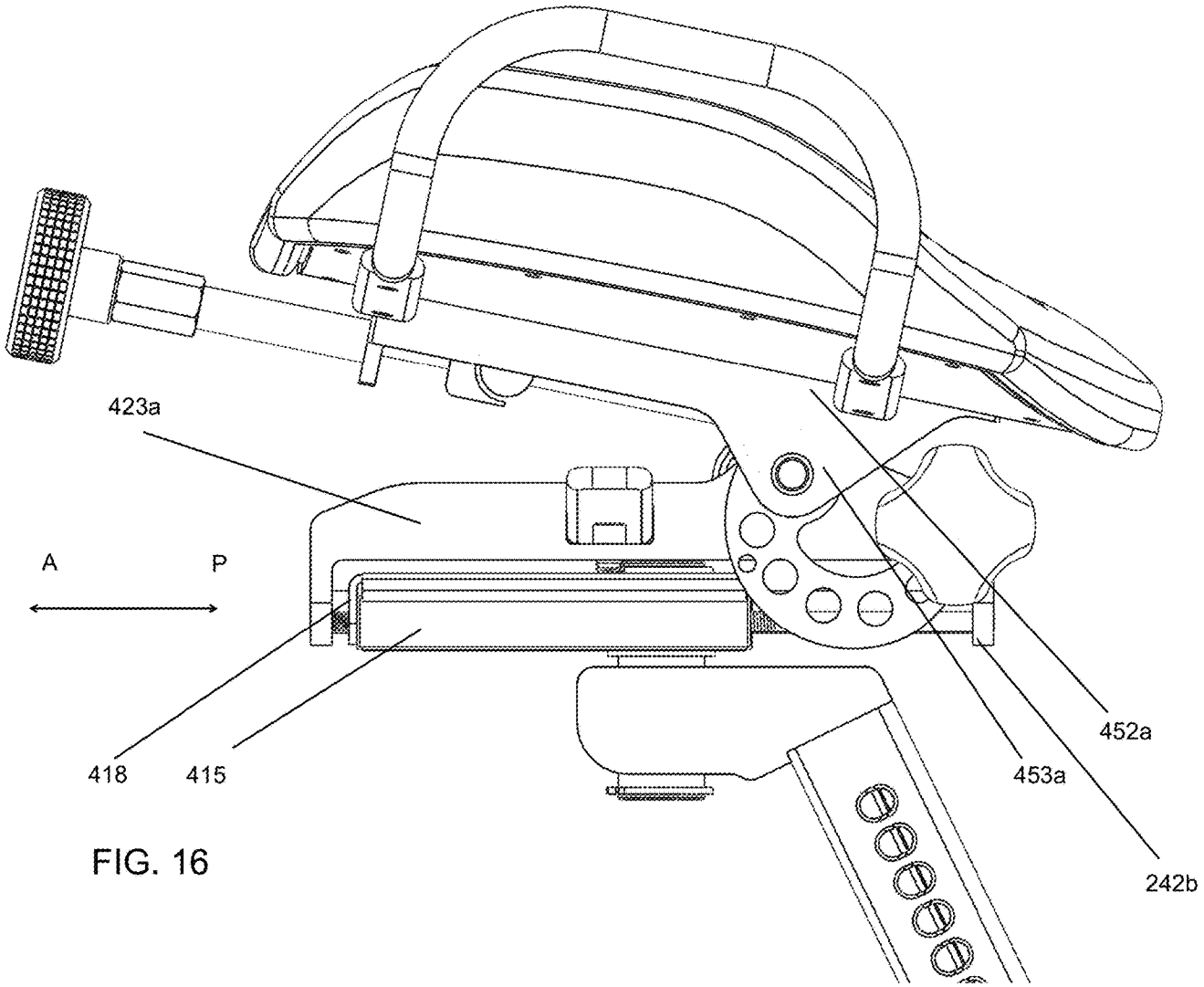
FIG. 16 is a right side view of the seat of the chair of FIG. 1.
Figure 17:
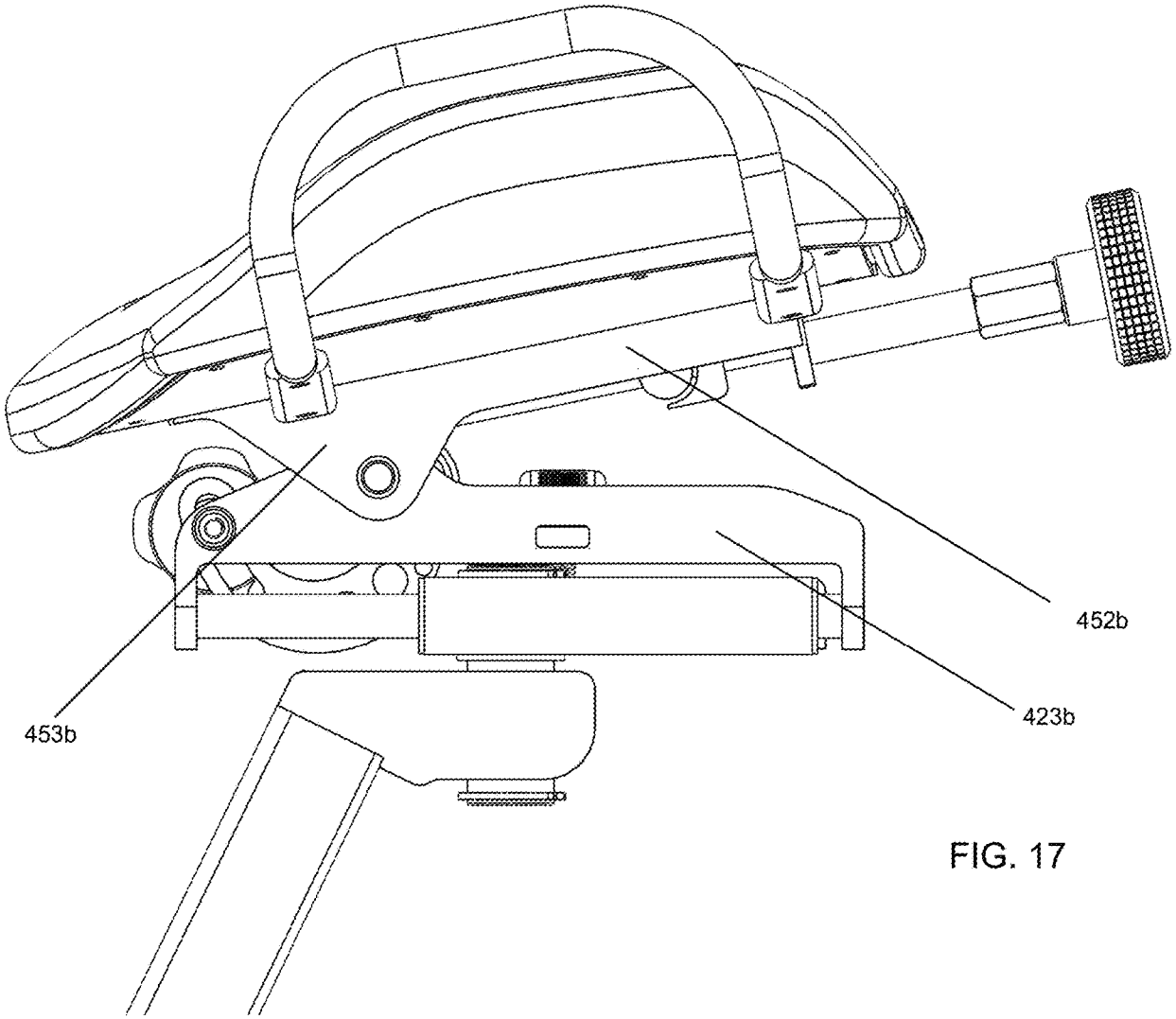
FIG. 17 is a left side view of the seat of the chair of FIG. 1.
Figure 18:
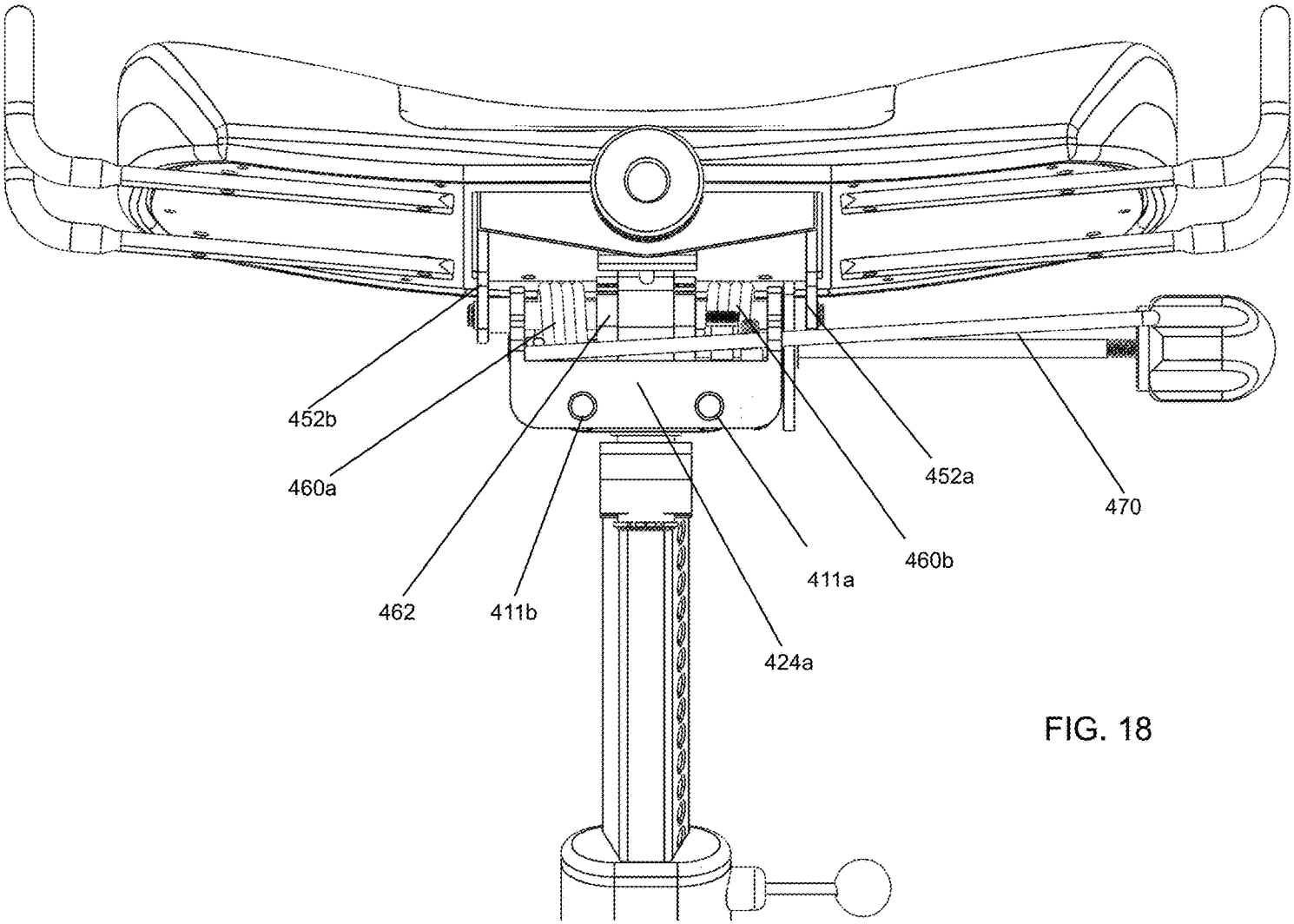
FIG. 18 is a rear side view of the seat of the chair of FIG. 1.
Figure 19:
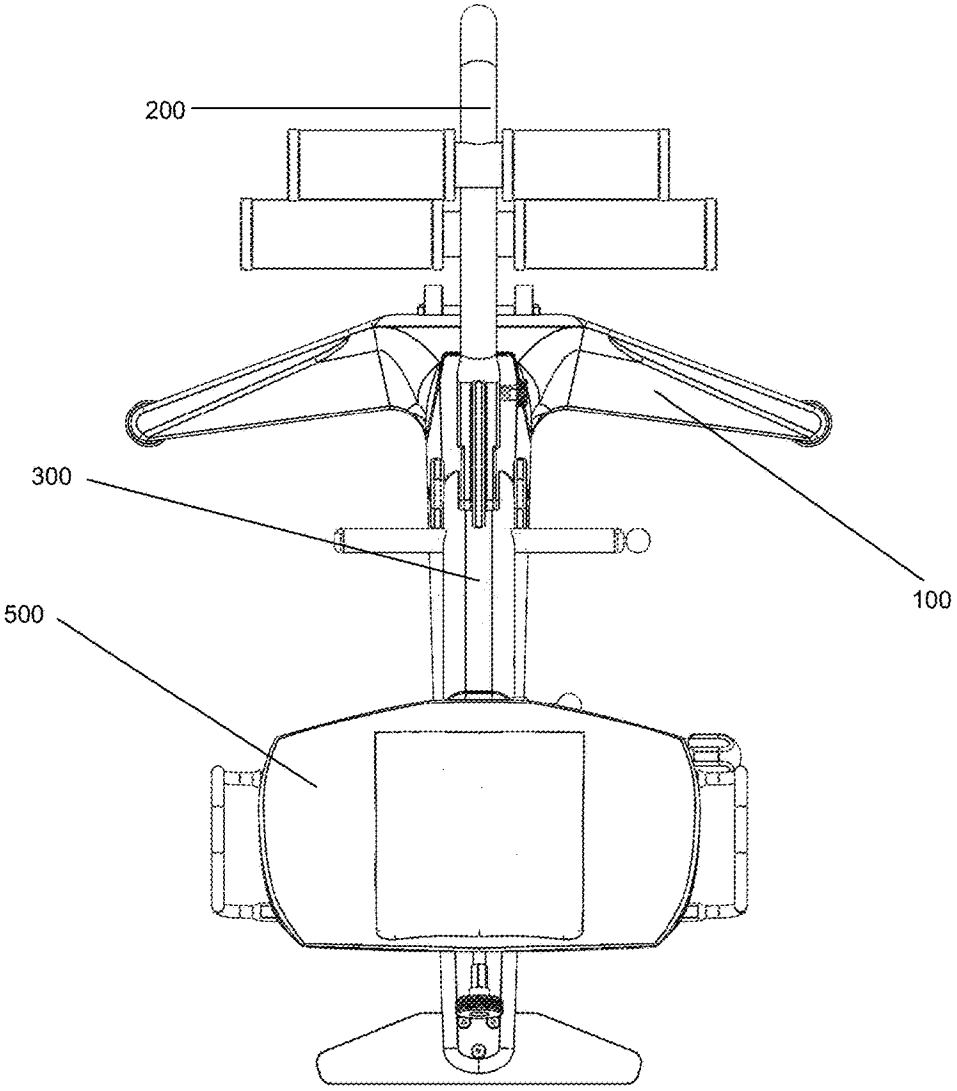
FIG. 19 is a top view of the chair of FIG. 1.
Figure 20:
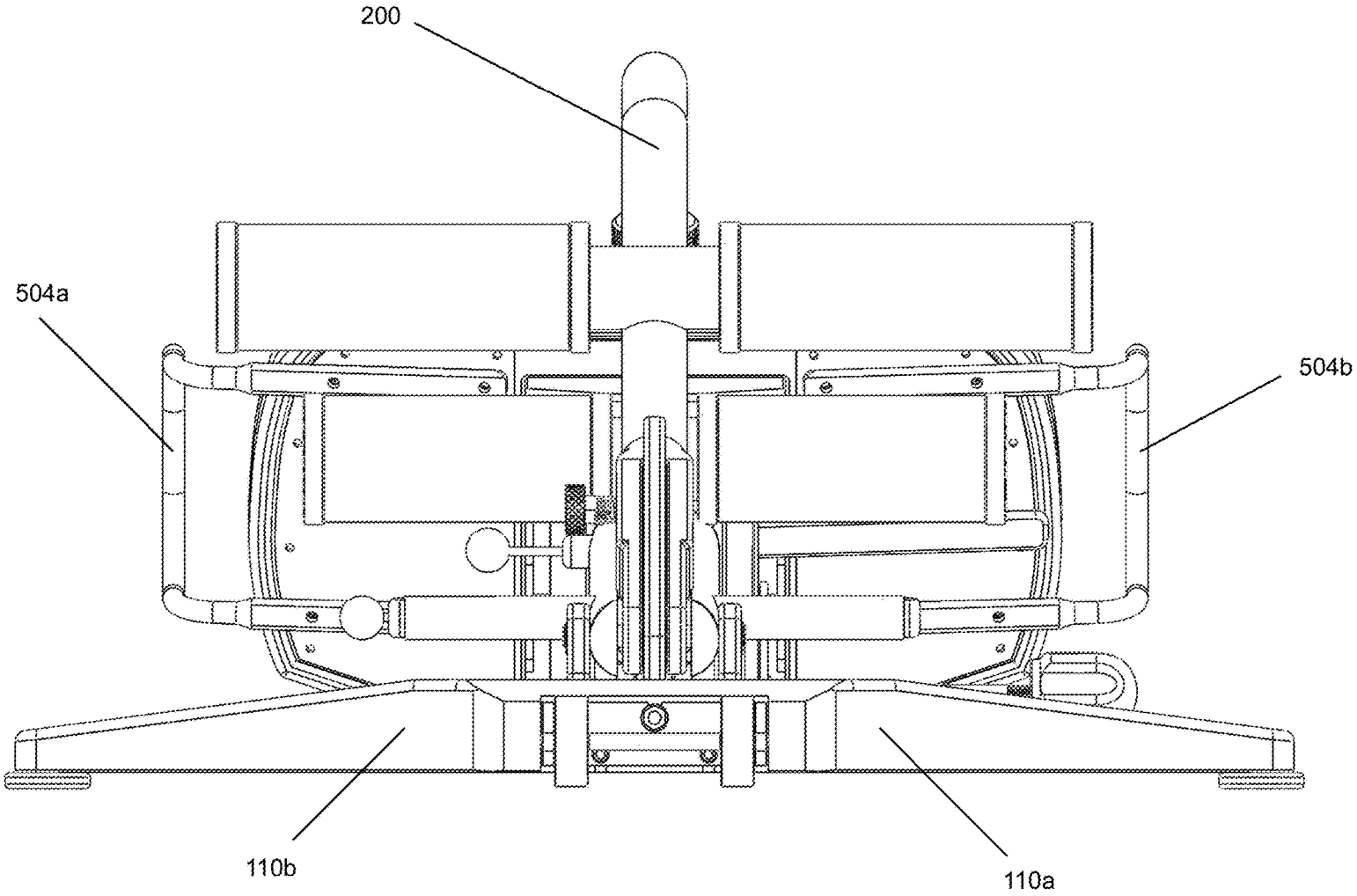
FIG. 20 is a top view of the chair of FIG. 1 in a collapsed configuration.

The seat adjustment mechanism 400 can provide, for example, three degrees of freedom, or adjustment, for the seat 500 relative to the seat tube assembly 300. As noted above, the yaw pin 402 can be seated in the seat tube adapter 380 to allow the seat 500 to pivot about the seat tube adapter 380, as illustrated in FIG. 11. Further, a user may desire to adjust the anterior/posterior location of the seat, relative to the seat tube adapter 380. To achieve this sliding ability of the seat, a rod base 410 can be fixed onto the proximal end of the yaw pin 402. The yaw pin 402 can be disposed in a through hole of the rod base 410 or can be welded to an underside 410*u* of the rod base 410. The rod base 410 can slidably support a slider top plate 420 which can permit the seat 500 to slide anteriorly A and posteriorly P as shown in FIG. 16. The slider top plate 420 can include a substantially flat rectangular plate 422 having two downward extending sidewalls 424*a*, 424*b*, parallel to one another on a first two sides and two upward extending parallel sidewalls 423*a*, 423*b* on the other two sides.

Figure 14:
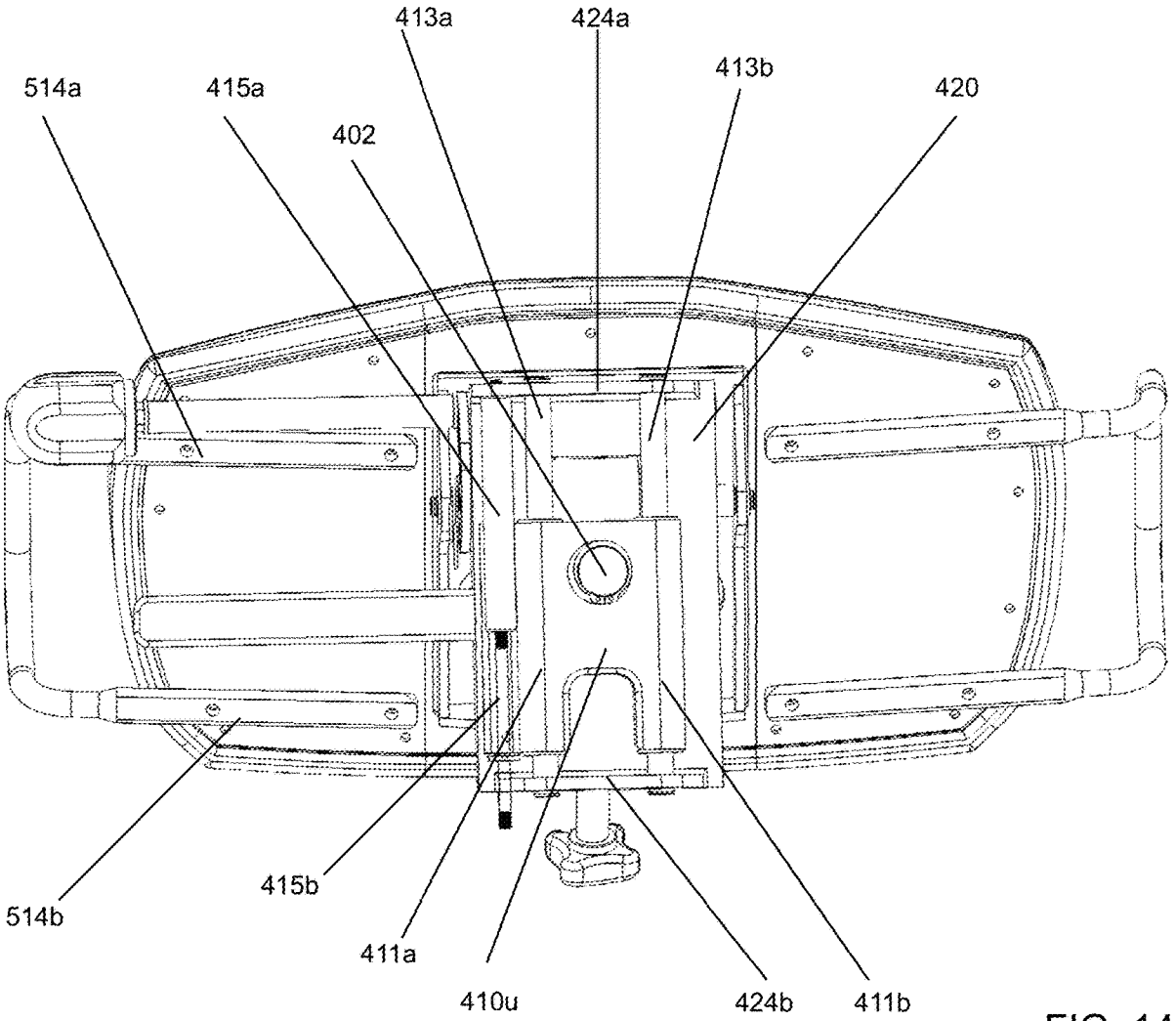
FIG. 14 is a bottom view of the seat adjustment mechanism of the chair of FIG. 1.
Figure 15:
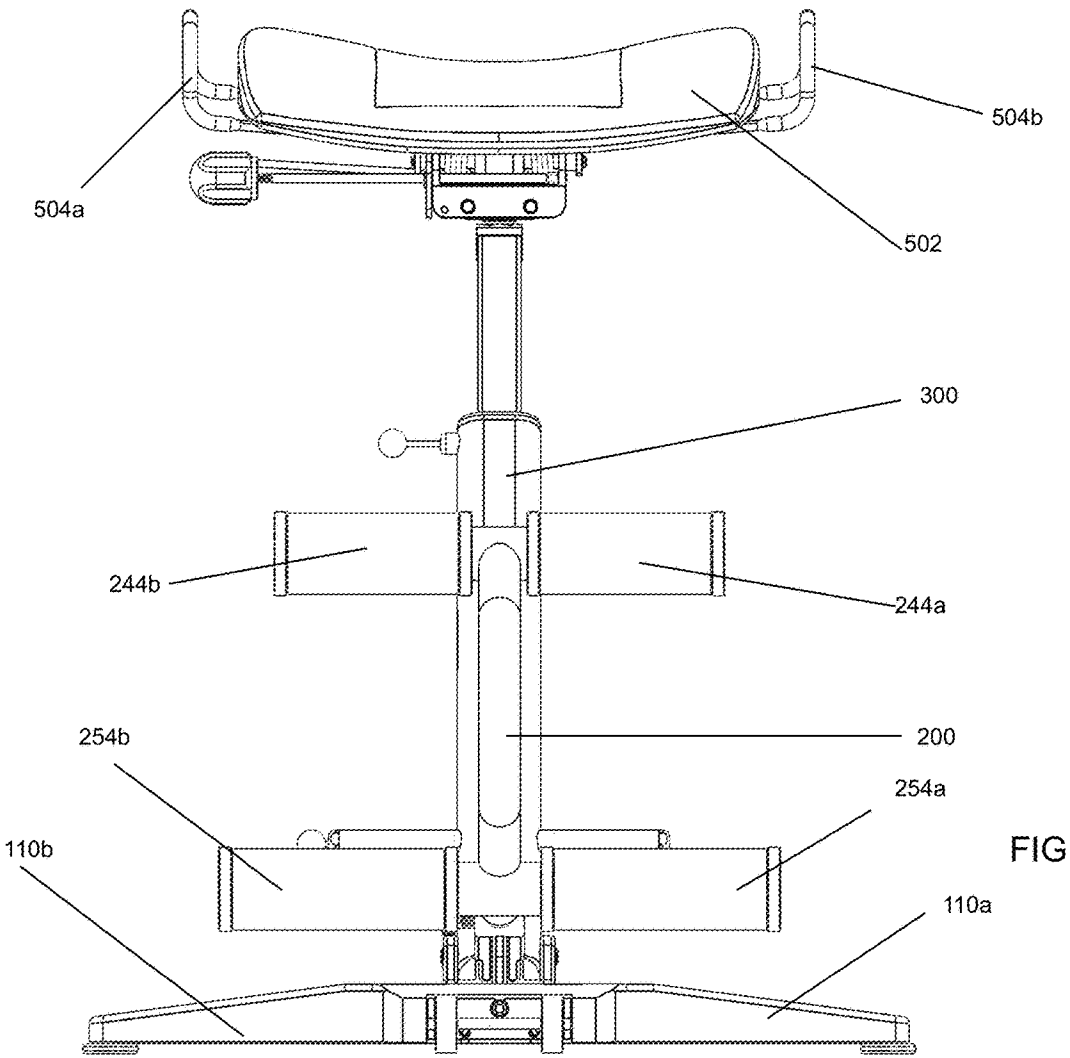
FIG. 15 is a front view of the chair of FIG. 1.

The rod base can include two through holes 411*a*, 411*b* which are oriented perpendicular to the yaw pin 402. The two through holes 411*a*, 411*b* can be spaced apart a set distance and have a diameter D3. The diameter D3 of the through holes 411*a*, 411*b* can be sized to slidably receive rod shafts 413*a*, 413*b*. The two through holes 411*a*, 411*b* can have oil embedded flange sleeve bearings, not shown, to reduce any frictional forces between the through holes 411*a*, 411*b* and the rod shafts 413*a*, 413*b*. The two rod shafts 413*a*, 413*b* can be secured to the downward side walls 424*a*, 424*b* of the top slider plate 420 so that the as the rods 413*a*, 413*b* move relative to the rod base 410, the top slide plate 420 moves as well. The assembly can additionally include a gas spring 415 which can provide resistance to the rods 413*a*, 413*b* from sliding relative to the rod base 410. As shown in FIG. 14, the gas spring 415, can have a first end, or the cylinder, 415*a* fixed in the downward side wall 424*b* and the other end, or piston rod 415*b*, fixed to a flange 418 in the base 410 such that it is parallel to the two rods 413*a*, 413*b*. In some embodiments, the gas spring 415 can be adjustable to provide the user the ability to adjust the amount of resistance to sliding of the slider top plate 420 relative to the base 410.

In addition to the sliding movement of the seat 500 and the pivoting about the yaw pin 402, the seat 500 can additionally pivot about an axis that is perpendicular to both the yaw pin and the sliding rods. This further pivoting can provide a user with the ability to adjust the pelvic alignment of the seat 500. Additionally, pivoting about the yaw pin 402 can provide a user with the ability to perform a rocking movement to support muscles of the spine and provide relieve from the strain of maintaining static seated positions. The slider top plate 420 can include through holes 424*a*, 424*b* in the respective upward sidewalls 423*a*, 423*b*. A seat hinge pin 430 can be inserted through the through holes 424*a*, 424*b*. A seat mount 450 can be pivotally disposed on the seat hinge pin 430 to create a "hinge" joint between the seat 500 and the slider top plate 420. The seat mount 450 can include two downward depending sidewalls 452*a*, 452*b* each of which can be parallel to the upward sidewalls 423*a*, 423*b*. The two downward depending sidewalls 452*a*, 452*b* can each include an ear 453*a*, 453*b* which have coaxially aligned through holes. The two downward depending sidewalls 452*a*, 452*b* can be offset from one another such that when they are joined to the hinge pin 430 they are disposed outward of the two upward sidewalls 423*a*, 423*b*.

In order to prevent the seat mount 450 from freely pivoting about the hinge pin 430, a set of torsion springs 460*a*, 460*b* can be disposed on the pin 430 on either side of a belt 462*a*. The two torsion springs 460*a*, 460*b* and the belt drum 462*b* can be disposed on the pin 430 between the two upper sidewalls 423*a*, 423*b*. Alternatively, other arrangements of the torsion springs 460*a*, 460*b* are within the scope of this disclosure. One arm of each of the torsion springs 460*a*, 460*b* can be disposed within the belt drum 462*b* and the other arm of each of the torsion springs can apply a counter force to the slider top plate 420 to resist pivoting movement of the seat mount 450. The torsional resistance provided by the torsion springs 460*a*, 460*b* can be adjusted by rotating the tension knob 480, which is connected to a screw type mechanism that can apply a force to the belt 462*a*. The belt 462*a* can transmit the force to the perimeter of belt drum 462*b* to vary the torque on springs 460*a* and 460*b*. The slider top plate 420 can further include a stop finger plate 470 extending outward from the upward extending sidewall 423*a* to serve as a physical barrier to the seat mount 450 from over rotating or pivoting. The stop finger plate 470 can be engaged or disengaged through actuation of the stop knob 471 which applies or releases friction on the stop finger plate.

The seat mount plate 450 can securely retain the cushioned seat 500 such that the seat 500 is able to be angularly adjusted relative to the base 100, height adjusted relative to the base 100, pivot about the yaw pin 402, slide on the rods 413*a*, 413*b*, and pivot about the hinge pin 430. The seat 500 can be secured to the seat mount plate using a plurality of screws, nails, staples, glue, or can be welded. The seat 500 can generally include a fabric covered cushion 502 and two laterally extending handles 504*a*, 504*b*. The cushion 502 can be manufactured from a single piece of material, such as polyurethane, foam, memory foam, or other materials mounted on a piece of wood, metal, or plastic, not shown, and covered with fabric. In an alternative embodiment, the cushion 502 can be made from a plurality of pieces of material. The shape of the seat can be shaped to position a user's pelvis into more ergonomic positions that support healthy strain-reducing spine postures. The pivoting of the seat, as discussed above, further aids in achieving this desired outcome.

In order to provide the user with additional support, the seat 500 can include two handles 504*a*, 504*b*. The two handles 504*a*, 504*b* can generally be the same shapes and size. For ease of discussion, one handle 504*a* will be discussed in detail. The handle 504*a* can have a generally upside-down U-shape with a further perpendicular bend at the ends of each arm of the U to form anchor arms 514*a*, 514*b*. The anchor arms 514*a*, 514*b* can be perpendicular to the top portion of the U-shape and can be screwed into the bottom of the seat 500 to secure them thereto. In the illustrated embodiment, the U-shape 510 is formed of a circular rod portion and the anchor arms 514*a*, 514*b* are shown as flat plates. However, the handles 504*a*, 504*b* can be formed from any suitable cross-sectional shape.

In use, a user can fully adjust the seat 10 in a wide range of orientations, as shown throughout the figures. For example, in a fully opened, or unfolded configuration, the foot rest locking pin 226 can be released to allow the foot rest post 200 to be rotated about the pivot pin 146. The foot rest post 200 can be advanced to one of the through holes 132*a*-132*e* and the locking pin 226 can then be released at the correct ergonomic position for the user. Once the locking pin 226 is released it can be inserted into the respective through hole 132*a*-132*e* to lock the relative angle of the foot rest post 200. Similarly, locking pin 340 of the seat tube, or post, 300 can be released from the arc 130 and the seat post 300 can be rotated up to the arc through hole 133, for example as shown in FIG. 2A. The retaining mechanism 350 can be actuated into the notch 134 to prevent the seat post 300 from rotating forwards when the user wants to position the chair on the floor. In an alternative configuration, the seat post 300 can be rotated further from the orientation of FIG. 2A, such that the locking pin 340 is disposed in a forward location 133*p* of the arc through hole 133, as shown in FIG. 2B. The configuration of FIG. 2B can be useful, e.g., when a user is standing at a desk.

The seat tube 300 can be further adjusted by releasing the height locking pin 370 to move the inner tube 360 within the seat tube 310. Sliding the inner tube 360 within the seat tube 310 can adjust the height of the seat 500. In some instances, it may be beneficial to lower the seat 500 if the chair 10 is being used at a traditional sitting desk. Alternatively, the seat 500 can be raised if the chair is being used in connection with a standing desk.

The seat 500 itself can be adjusted relative to the seat post 300 in at least three degrees of freedom, as discussed above. The seat 500 can rotate about the yaw pin 402 to advantageously access the entirety of a desktop, to enter and exit the seat, to provide optimal seating comfort in a number of different positions, and for compact storage in the stowage configuration. From a health/ergonomic perspective, the pivoting about the yaw pin 402 can allow a user to rotate/twist their body. This movement can provide muscle relief and help increase circulation through the user's spine and body. The seat 500 can be pivoted about the hinge pin 430 to ensure that there is proper pelvic alignment and allow rocking movement that can give the muscles that support the spine breaks from the strain of maintaining static seated positions. Additionally, the seat 500 can be moved anteriorly A or posteriorly P, away and towards the foot rest 200, to ensure that the users legs are properly supported.

When a user no longer needs the chair 10 in an unfolded configuration, the above steps can be reversed to collapse the chair into the collapsed configuration, as shown in FIG. 2C. Optionally, the inner tube 360 can be lowered fully into the seat tube 310. The retaining mechanism 350 and the locking pin 370 can be released to allow the seat post 300 to rotate towards through hole 135*b* on the arc 130. Once the seat post has been fully collapsed, the locking pin 370 can be inserted into the through hole 135. The foot rest post 200 can similarly be unlocked and rotated towards through hole 135*a* to be locked for the collapsed configuration. The user can then lift the base 100 from, for example, the rear stability plate 150 to pivot the assembly upwards on the wheels 126*a*, 126*b* to roll the chair 10 into a storage location.

The chair of the present invention addresses the shortcomings of the prior art. For example, the chair can flip under the desk when not in use. It provides micro- and macro-movement core exercises, as well as other fitness exercises for other parts of the body, multiple seating, standing and leaning positions to maximize comfort and health. It provides fully adjustable pelvic rotation with graduated damping. It provides adjustable sit-up, back extension, and stretching exercise capability. It also incorporates multiple foot rests at ergonomically recommended (and comfortable) locations in front of chair in addition to foot rests that can be used while sitting. Further, pegs at the center of the base can be used to support the user in a variety of standing positions. Further, it utilizes an ergonomically designed seat with customizable features to suit any body shape, and a custom combination of polyurethane foams that provide optimal support and comfort. In addition, it quickly and easily folds into a compact, easy to transport package. It is may be constructed of wood or stamped or cast aluminum components for low-cost and light weight. Thus, the chair is designed for manufacturability, using stampings, castings, machined, and injection molded parts to reduce cost.

It would be appreciated by those skilled in the art that various changes and modifications can be made to the illustrated embodiments without departing from the spirit of the present invention. All such modifications and changes are intended to be covered by the appended claims.

What is claimed is:

1. An ergonomic chair, comprising:

a base including a central support and at least one lateral support;

a seat post having a first end and a second end;

the seat post being pivotally connected to the base by the first end of the seat post;

a seat connected to the second end of the seat post;

a seat mechanism disposed between the seat and the second end of the seat post, the seat mechanism is configured to pivot and slide the seat anteriorly and posteriorly, wherein the seat mechanism includes a seat support spring to adjust a stiffness of the pivoting of the seat;

a foot rest post having a first end and a second end, the foot rest post being pivotally connected to the base by the first end of the foot rest post;

a first foot rest connected to the second end of the foot rest post; and a second foot rest connected to an intermediate portion of the foot rest post.

2. The ergonomic chair of claim 1, wherein the seat post is telescopically adjustable.

3. The ergonomic chair of claim 1, wherein the foot rest post is pivotally adjustable around a main pivot connection pin.

4. The ergonomic chair of claim 1, wherein the seat is slidably adjustable relative to the seat post in the anterior and posterior directions.

5. The ergonomic chair of claim 1, wherein the seat post includes integral foot supports.

6. The ergonomic chair of claim 1, further comprising at least one additional foot rest.

7. The ergonomic chair of claim 1, wherein an angle of the seat is adjustable and includes an adjustable stop to limit how far forward the seat can tilt or pivot.

8. The ergonomic chair of claim 1, wherein the base further includes wheels for ease of transport.

9. The ergonomic chair of claim 1, wherein the chair is foldable to facilitate storage and transport.

10. The ergonomic chair of claim 1, wherein the base further includes an arc extending from the top of the central support configured to be slidably received by both the seat post and the foot rest post.

11. The ergonomic chair of claim 10, wherein the seat post and the foot rest post each include a locking mechanism to fix their pivotal location with respect to the arc.

12. The ergonomic chair of claim 1, wherein the seat includes a plurality of handles.

* * * * *